US011766867B2

(12) United States Patent
Hattori

(10) Patent No.: US 11,766,867 B2
(45) Date of Patent: Sep. 26, 2023

(54) RECORDING HEAD CLEANING DEVICE, RECORDING HEAD CLEANING METHOD, AND RECORDING DEVICE

(71) Applicant: FUJIFILM Corporation, Tokyo (JP)

(72) Inventor: Kazumasa Hattori, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 214 days.

(21) Appl. No.: 17/223,009

(22) Filed: Apr. 6, 2021

(65) Prior Publication Data

US 2021/0221139 A1 Jul. 22, 2021

Related U.S. Application Data

(63) Continuation of application No. PCT/JP2019/042858, filed on Oct. 31, 2019.

(30) Foreign Application Priority Data

Nov. 8, 2018 (JP) ..... 2018-210402

(51) Int. Cl.
*B41J 2/165* (2006.01)

(52) U.S. Cl.
CPC ..... *B41J 2/16535* (2013.01); *B41J 2/16552* (2013.01)

(58) Field of Classification Search
CPC ..... B41J 2/16535; B41J 2/16552; B41J 2002/16558
See application file for complete search history.

(56) References Cited

U.S. PATENT DOCUMENTS 8,282,188 B2 10/2012 Maida
2005/0104926 A1* 5/2005 Yamada ..... B41J 2/16552 347/34

(Continued)

FOREIGN PATENT DOCUMENTS

JP 2010234740 10/2010
JP 2011212876 10/2011

(Continued)

OTHER PUBLICATIONS

"Office Action of Japan Counterpart Application" with English translation thereof, dated May 17, 2022, p. 1-p. 10.

(Continued)

*Primary Examiner* — Sharon Polk
(74) *Attorney, Agent, or Firm* — JCIPRNET

(57) ABSTRACT

Provided is a recording head cleaning device, a recording head cleaning method, and a recording device, with which a cleaning liquid from a nozzle is prevented from being mixed and a nozzle surface is cleaned. The problem is solved with a recording head cleaning device including a cleaning liquid holding unit that has a cleaning liquid holding surface, a cleaning liquid applying portion that applies a cleaning liquid to the cleaning liquid holding surface, a cleaning unit that cleans a nozzle surface of a recording head, in which a nozzle jetting an ink is disposed, with the cleaning liquid held by the cleaning liquid holding surface by making the cleaning liquid holding surface and the nozzle surface face each other, the nozzle surface with the cleaning liquid held by the cleaning liquid holding surface, and a back pressure control unit that sets a back pressure of the nozzle in a case of cleaning the nozzle surface to −800 pascals to −200 pascals.

15 Claims, 17 Drawing Sheets

(56) References Cited

U.S. PATENT DOCUMENTS

| | | | | |
|---|---|---|---|---|
| 2014/0097267 | A1* | 4/2014 | Shitara | B05B 15/555 134/99.1 |
| 2016/0075154 | A1 | 3/2016 | Hacker et al. | |
| 2018/0079217 | A1 | 3/2018 | Hiratsuka et al. | |
| 2018/0264822 | A1* | 9/2018 | Tanioku | B41J 2/16535 |

FOREIGN PATENT DOCUMENTS

| | | |
|---|---|---|
| JP | 2015054496 | 3/2015 |
| JP | 2018047609 | 3/2018 |

OTHER PUBLICATIONS

"International Search Report (Form PCT/ISA/210) of PCT/JP2019/042858," dated Dec. 3, 2019, with English translation thereof, pp. 1-5.

"Written Opinion of the International Searching Authority (Form PCT/ISA/237) of PCT/JP2019/042858," dated Dec. 3, 2019, with English translation thereof, pp. 1-14.

* cited by examiner

RECORDING HEAD CLEANING DEVICE, RECORDING HEAD CLEANING METHOD, AND RECORDING DEVICE

CROSS-REFERENCE TO RELATED APPLICATIONS

The present application is a Continuation of PCT International Application No. PCT/JP2019/042858 filed on Oct. 31, 2019 claiming priority under 35 U.S.C § 119(a) to Japanese Patent Application No. 2018-210402 filed on Nov. 8, 2018. Each of the above applications is hereby expressly incorporated by reference, in its entirety, into the present application.

BACKGROUND OF THE INVENTION

1. Field of the Invention

The present invention relates to a recording head cleaning device, a recording head cleaning method, and a recording device, and particularly relates to a technique of cleaning a nozzle surface of a recording head.

2. Description of the Related Art

In an ink jet recording device, in a case where a nozzle surface of an ink jet head becomes dirty due to a deteriorated ink, a nozzle with a jetting abnormality is generated. In particular, in a case where the nozzle with a jetting abnormality is generated in a line head, streak unevenness is generated in a recorded image, and thus the image quality is significantly reduced. Therefore, the ink jet recording device performs the maintenance of the ink jet head, such as a preliminary jet, pressurizing purge, nozzle surface wiping, and nozzle suction, in order to prevent the occurrence of a jetting abnormality beforehand and to quickly correct the jetting abnormality.

In addition, JP2010-234740A discloses a head cleaning device comprising a cleaning liquid holding unit that includes a cleaning liquid holding surface facing a nozzle surface of an ink jet head, which is provided to be inclined with respect to a horizontal surface, at a predetermined distance and a cleaning liquid supplying unit that has a cleaning liquid supply port through which a cleaning liquid is supplied from an upper portion of the tilt of the cleaning liquid holding surface such that the cleaning liquid forms meniscus between the cleaning liquid holding surface and the nozzle surface while slipping along the tilt of the nozzle surface.

With the head cleaning device described in JP2010-234740A, the cleaning liquid is applied to the entire surface of the nozzle surface of the ink jet head, and thus the nozzle surface can be cleaned.

SUMMARY OF THE INVENTION

However, in a case where the cleaning liquid is applied to the nozzle surface, the cleaning liquid which is mixed with the dirt of the nozzle surface enters the inside of the recording head from the nozzle, causing a problem that the inside of the recording head is contaminated.

The present invention is devised in view of such circumstances, and an object thereof is to provide a recording head cleaning device, a recording head cleaning method, and a recording device, with which a cleaning liquid from a nozzle is prevented from being mixed and a nozzle surface is cleaned.

According to an aspect of the invention, in order to achieve the object, there is provided a recording head cleaning device comprising a cleaning liquid holding unit that has a cleaning liquid holding surface, a cleaning liquid applying portion that applies a cleaning liquid to the cleaning liquid holding surface, a cleaning unit that cleans a nozzle surface of a recording head, in which a nozzle jetting an ink is disposed, with the cleaning liquid held by the cleaning liquid holding surface by making the cleaning liquid holding surface and the nozzle surface face each other, and a back pressure control unit that sets a back pressure of the nozzle in a case of cleaning the nozzle surface to −800 pascals to −200 pascals.

According to the present aspect, since the back pressure of the nozzle in the case of cleaning the nozzle surface with the cleaning liquid held by the cleaning liquid holding surface with the cleaning liquid holding surface and the nozzle surface of the recording head, in which the nozzle jetting the ink is disposed, facing each other is set to −800 pascals to −200 pascals, the cleaning liquid from the nozzle is prevented from being mixed and the nozzle surface can be cleaned.

It is preferable that the back pressure control unit sets the back pressure of the nozzle in the case of cleaning the nozzle surface to −700 pascals to −300 pascals. In addition, it is preferable that the back pressure control unit sets the back pressure of the nozzle in the case of cleaning the nozzle surface to −600 pascals to −400 pascals. Accordingly, the cleaning liquid from the nozzle is prevented from being mixed and the nozzle surface can be cleaned.

It is preferable that the cleaning unit relatively moves the recording head in a first direction parallel to the cleaning liquid holding surface in a state where the cleaning liquid holding surface and the nozzle surface face each other. Accordingly, even in a case where the nozzle surface is larger than the cleaning liquid holding surface in the first direction, the nozzle surface can be appropriately cleaned.

It is preferable to further comprise a wiping portion that wipes the nozzle surface with a wiping member. Accordingly, the nozzle surface after cleaning can be wiped.

It is preferable that the back pressure control unit sets the back pressure of the nozzle in a case of wiping the nozzle surface to −2,100 pascals to −1,900 pascals. Accordingly, the nozzle surface can be wiped without drawing out the ink in the nozzle.

It is preferable that the cleaning liquid holding surface has a rectangular shape of which a length in the first direction is W and a length in a second direction orthogonal to the first direction is Dm, the cleaning unit causes the cleaning liquid holding surface and the nozzle surface of the recording head, of which a length in the second direction is Dh which is smaller than Dm, to face each other at a distance H, and the cleaning liquid applying portion applies a larger amount of the cleaning liquid than W×Dh×H. Accordingly, a space between the cleaning liquid holding surface and the nozzle surface can be filled with the cleaning liquid, and the nozzle surface can be appropriately cleaned.

It is preferable that in the recording head, a plurality of head modules, in which the nozzles are disposed, are arranged in the first direction. Accordingly, the nozzle surface of each head module of the recording head in which the plurality of head modules are arranged in the first direction can be cleaned.

It is preferable that the cleaning liquid holding unit has a cleaning liquid supply port in the cleaning liquid holding surface, and the cleaning liquid applying portion causes the cleaning liquid to be spurted from the cleaning liquid supply port. Accordingly, the cleaning liquid can be appropriately applied to the cleaning liquid holding surface.

It is preferable that the nozzle surface has a liquid repellent nozzle portion, in which a plurality of the nozzles are disposed, and a non-nozzle portion, which has liquid repellency relatively lower than the nozzle portion, and the cleaning unit causes the cleaning liquid supply port and the non-nozzle portion to face each other. Accordingly, the nozzle surface can be appropriately cleaned.

It is preferable that the cleaning unit causes the cleaning liquid holding surface and the nozzle surface to face each other in a state of being tilted with respect to a horizontal surface. As described above, even in a case where the nozzle surface is horizontally tilted, the nozzle surface can be appropriately cleaned.

It is preferable that the nozzle jets an ink containing at least one of a metal pigment or carbon black. Accordingly, the nozzle surface of the recording head that jets the ink containing at least one of the metal pigment or the carbon black can be appropriately cleaned.

According to another aspect of the invention, in order to achieve the object, there is provided a recording device comprising the recording head cleaning device, the recording head, a movement unit that relatively moves the recording head and a recording medium, and a recording control unit that controls the recording head and the movement unit to record an image on the recording medium.

According to the present aspect, the image can be recorded on the recording medium by the recording head of which the nozzle surface is appropriately cleaned.

It is preferable that the back pressure control unit sets the back pressure of the nozzle in a case of recording the image to −1,100 pascals to −900 pascals. Accordingly, the image can be appropriately recorded.

According to still another aspect of the invention, in order to achieve the object, there is provided a recording head cleaning method comprising a cleaning liquid applying step of applying a cleaning liquid to a cleaning liquid holding surface of a cleaning liquid holding unit having the cleaning liquid holding surface, a cleaning step of cleaning a nozzle surface of a recording head, in which a nozzle jetting an ink is disposed, with the cleaning liquid held by the cleaning liquid holding surface by making the cleaning liquid holding surface and the nozzle surface face each other, and a back pressure controlling step of setting a back pressure of the nozzle in a case of cleaning the nozzle surface to −800 pascals to −200 pascals.

According to the present aspect, since the back pressure of the nozzle in the case of cleaning the nozzle surface with the cleaning liquid held by the cleaning liquid holding surface with the cleaning liquid holding surface and the nozzle surface of the recording head, in which the nozzle jetting the ink is disposed, facing each other is set to −800 pascals to −200 pascals, the cleaning liquid from the nozzle is prevented from being mixed and the nozzle surface can be cleaned.

With the present invention, the cleaning liquid from the nozzle is prevented from being mixed and the nozzle surface can be cleaned.

DESCRIPTION OF THE PREFERRED EMBODIMENTS

Hereinafter, a preferable embodiment of the present invention will be described in detail with reference to the accompanying drawings. Herein, an example of cleaning an ink jet head will be described.

<Configuration of Image Recording Unit of Ink Jet Recording Device>

An example in which an ink jet recording device that records an image on a recording medium is applied as a recording device according to the present invention will be described. The term recording medium used in recording images is a general term for what is called in various terms, such as paper, recording paper, printing paper, a printing medium, a printed medium, an image forming medium, an image formed medium, an image receiving medium, and a jetted medium. The material, the shape, and the like of the recording medium are not particularly limited, and various sheet bodies can be used, such as seal paper, a resin sheet, a film, cloth, and a non-woven fabric, regardless of the material and the shape thereof. Without being limited to a single-sheet medium, the recording medium may be a continuous medium, such as continuous paper, continuous-form paper, and a film for flexible packaging. The continuous medium may be stored in a roll shape.

Figure 1:
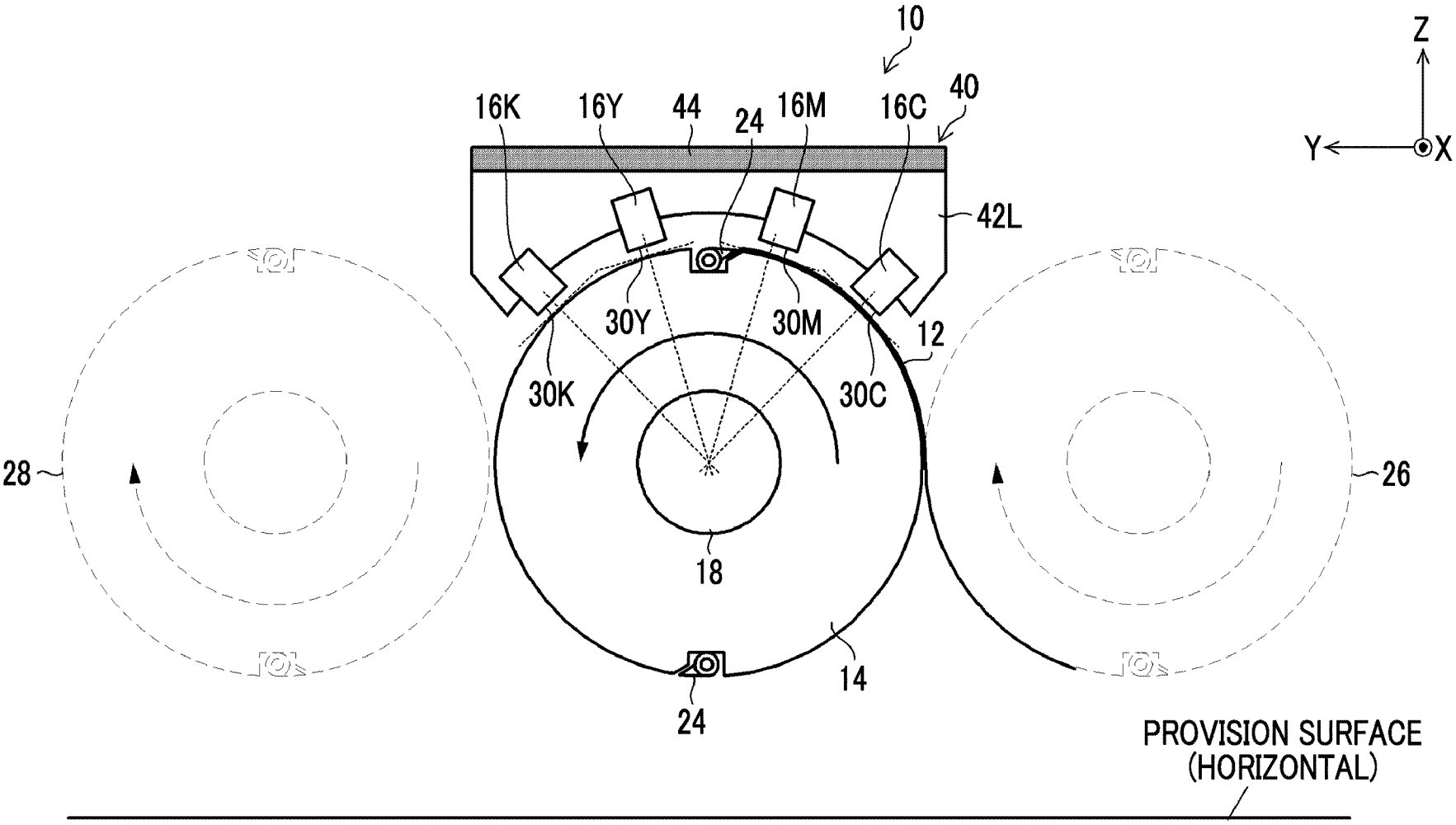
FIG. 1 is a side view of a schematic configuration of an image recording unit of an ink jet recording device.

FIG. 1 is a side view of a schematic configuration of the image recording unit of the ink jet recording device that records an image on single-sheet paper through a single-pass method. As shown in FIG. 1, an image recording unit 10 drum-transports single-sheet paper 12 with an image recording drum 14. In addition, as ink jet heads 16C, 16M, 16Y, and 16K provided in the vicinity of the image recording drum 14 jet ink droplets of respective colors, including cyan (C), magenta (M), yellow (Y), and black (K), the image recording unit 10 records a color image on the surface of the single-sheet paper 12 in the process of being transported by the image recording drum 14.

The image recording drum 14 has a rotary shaft 18. Both end portions of the rotary shaft 18 are rotatably provided by being pivotally supported by a pair of bearings 22 (refer to FIG. 2). The pair of bearings 22 is provided at a main body frame 20 of the ink jet recording device. As both end portions of the rotary shaft 18 are pivotally supported by the pair of bearings 22 to be parallel to a horizontal provision surface, the image recording drum 14 is horizontally attached.

A motor (not shown) is connected to the rotary shaft 18 via a rotation transmission mechanism (not shown). The image recording drum 14 is driven by the motor (not shown) and rotates.

The image recording drum 14 has grippers 24 that grip a leading end portion of the single-sheet paper 12. The grippers 24 are provided at two places on an outer circumferential surface of the image recording drum 14, respectively. The leading end portion of the single-sheet paper 12 is gripped by the grippers 24, and is held on the outer circumferential surface of the image recording drum 14.

The image recording drum 14 has a suction holding mechanism (not shown) such as using electrostatic suction and vacuum suction. The suction holding mechanism (not shown) sucks the back surface of the single-sheet paper 12, of which the leading end portion is gripped by the grippers 24 and which is wound around on the outer circumferential surface of the image recording drum 14, holding the single-sheet paper on the outer circumferential surface of the image recording drum 14.

The single-sheet paper 12 before image recording is delivered from a transporting drum 26 to the image recording drum 14. The transporting drum 26 is disposed to be juxtaposed with the image recording drum 14, and delivers the single-sheet paper 12 to the image recording drum 14 in accordance with a timing.

In addition, the single-sheet paper 12 after image recording is delivered from the image recording drum 14 to a transporting drum 28. The transporting drum 28 is disposed to be juxtaposed with the image recording drum 14, and receives the single-sheet paper 12 from the image recording drum 14 in accordance with a timing.

The four ink jet heads 16C, 16M, 16Y, and 16K are line heads corresponding to the length of the single-sheet paper 12 in an X-direction.

The ink jet heads 16C, 16M, 16Y, and 16K are attached to a head supporting frame 40, and are disposed radially at regular intervals on a concentric circle about the rotary shaft 18 of the image recording drum 14 and to be bilaterally symmetrical to each other with the image recording drum 14 interposed therebetween. That is, with respect to a vertical line segment passing through the center of the image recording drum 14, the cyan ink jet head 16C and the black ink jet head 16K are disposed to be bilaterally symmetrical to each other and the magenta ink jet head 16M and the yellow ink jet head 16Y are disposed to be bilaterally symmetrical to each other.

The ink jet heads 16C, 16M, 16Y, and 16K have nozzle surfaces 30C, 30M, 30Y, and 30K, each of which has nozzles 128 (refer to FIG. 5) disposed at a bottom portion. The ink jet heads 16C, 16M, 16Y, and 16K are disposed to be orthogonal to a Y-direction, which is a transporting direction of the single-sheet paper 12, and are disposed such that the nozzle surfaces 30C, 30M, 30Y, and 30K face the outer circumferential surface of the image recording drum 14. The ink jet heads 16C, 16M, 16Y, and 16K are disposed such that an interval between the outer circumferential surface of the image recording drum 14 and each of the nozzle surfaces 30C, 30M, 30Y, and 30K is the same distance.

The ink jet heads 16C, 16M, 16Y, and 16K jet ink droplets perpendicularly toward the outer circumferential surface of the image recording drum 14 from the nozzles 128 disposed in the nozzle surfaces 30C, 30M, 30Y, and 30K.

Figure 2:
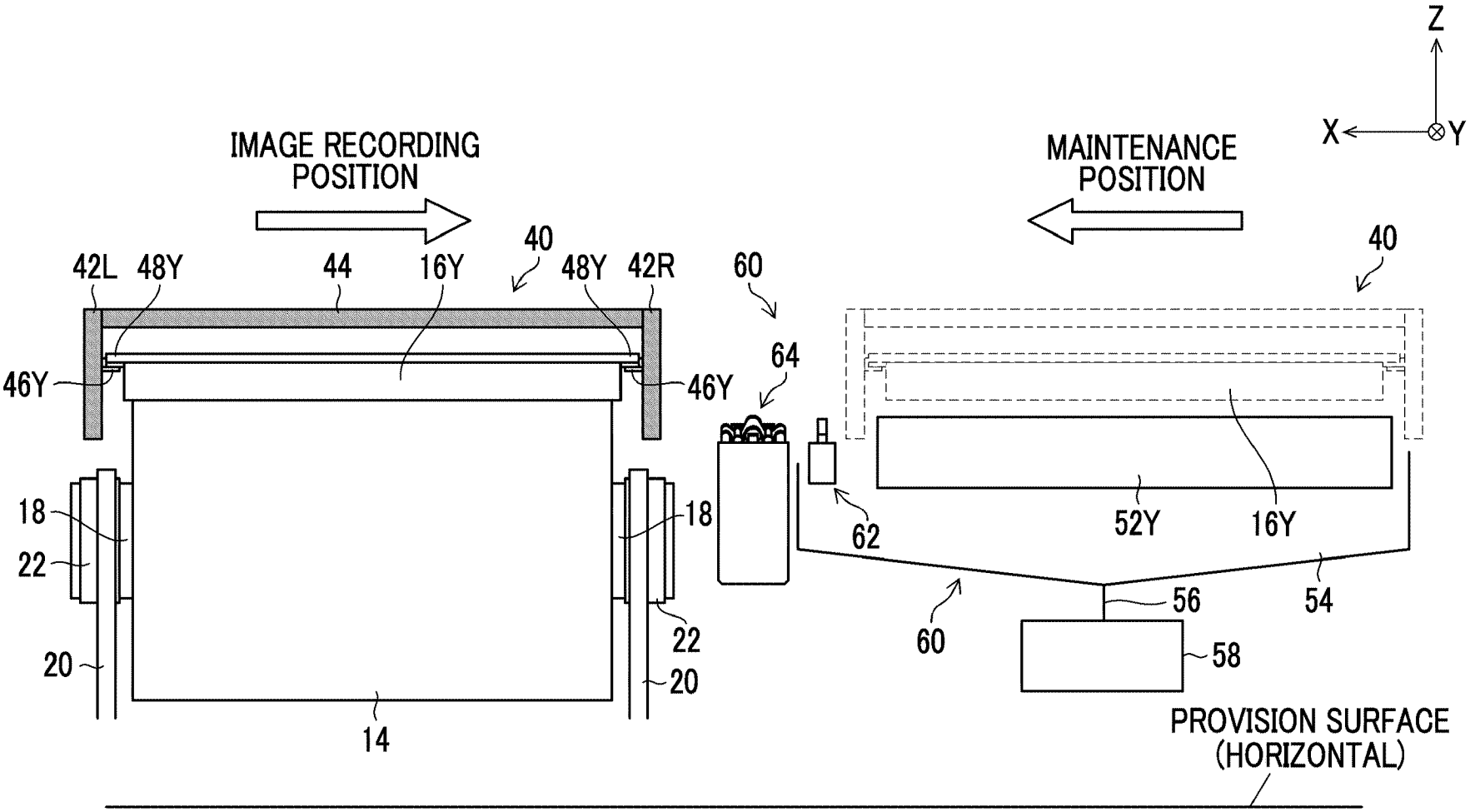
FIG. 2 is a front view showing a schematic configuration of the image recording unit of the ink jet recording device.

FIG. 2 is a front view showing a schematic configuration of the image recording unit of the ink jet recording device. The head supporting frame 40, to which the ink jet heads 16C, 16M, 16Y, and 16K are attached, is configured by a pair of side plates 42L and 42R provided to be orthogonal to the rotary shaft 18 of the image recording drum 14 and a connecting frame 44 that connects upper end portions of the pair of side plates 42L and 42R to each other.

The pair of side plates 42L and 42R has a plate shape, and is disposed to face each other with the image recording drum 14 interposed therebetween. On an inside of the pair of side plates 42L and 42R, attaching portions 46C, 46M, 46Y, and 46K for attaching the ink jet heads 16C, 16M, 16Y, and 16K are provided. For convenience, FIG. 2 shows only the attaching portion 46Y.

The attaching portions 46C, 46M, 46Y, and 46K are disposed radially at regular intervals on the concentric circle about the rotary shaft 18 of the image recording drum 14. As attached portions 48C, 48M, 48Y, and 48K (FIG. 2 shows only the attached portion 48Y for convenience) provided at both ends are fixed to the attaching portions 46C, 46M, 46Y, and 46K, the ink jet heads 16C, 16M, 16Y, and 16K are attached to the head supporting frame 40.

The head supporting frame 40 is guided by a guide rail (not shown), and is provided to be slidably movable in parallel with the rotary shaft 18 of the image recording drum 14. The head supporting frame 40 is driven by a linear drive mechanism (not shown) (for example, a feed screw mechanism and the like), and moves at a predetermined movement speed between an "image recording position" shown by a solid line in FIG. 2 and a "maintenance position" shown by a broken line in FIG. 2.

In a case where the head supporting frame 40 is positioned at the image recording position, the ink jet heads 16C, 16M, 16Y, and 16K are disposed in the vicinity of the image recording drum 14, and are in an image recordable state.

The maintenance position is set to a position where the ink jet heads 16C, 16M, 16Y, and 16K are retracted from the image recording drum 14. At the maintenance position, a moisturizing unit 50 for moisturizing the ink jet heads 16C, 16M, 16Y, and 16K is provided.

The moisturizing unit 50 comprises caps 52C, 52M, 52Y, and 52K (FIG. 2 shows only the cap 52Y for convenience) that cover the nozzle surfaces 30C, 30M, 30Y, and 30K of the ink jet heads 16C, 16M, 16Y, and 16K, respectively. In a case where the device is stopped for a long period of time, the nozzle surfaces 30C, 30M, 30Y, and 30K are covered with the caps 52C, 52M, 52Y, and 52K. Accordingly, it is possible to prevent non-jetting caused by the dry nozzles 128.

The caps 52C, 52M, 52Y, and 52K comprise a pressurizing mechanism (not shown) and a suction mechanism (not shown), and can pressurize and suck the nozzles 128. In addition, the caps 52C, 52M, 52Y, and 52K comprise a cleaning liquid supply mechanism (not shown), and can supply a cleaning liquid to the inside.

A waste liquid tray 54 is disposed at a position below the caps 52C, 52M, 52Y, and 52K. A cleaning liquid supplied to the caps 52C, 52M, 52Y, and 52K is discarded to the waste liquid tray 54, and is collected in a waste liquid tank 58 via a waste liquid collecting pipe 56.

Between the image recording position and the maintenance position, a nozzle surface cleaning device 60 for cleaning the nozzle surfaces 30C, 30M, 30Y, and 30K of the ink jet heads 16C, 16M, 16Y, and 16K is provided. By moving the ink jet heads 16C, 16M, 16Y, and 16K between the maintenance position and the image recording position, the nozzle surfaces 30C, 30M, 30Y, and 30K are cleaned by the nozzle surface cleaning device 60.

<Configuration Example of Ink Jet Head>

Since the configurations of the ink jet heads 16C, 16M, 16Y, and 16K are the same, the configuration of the ink jet head 16 will be described herein.

Figure 3:
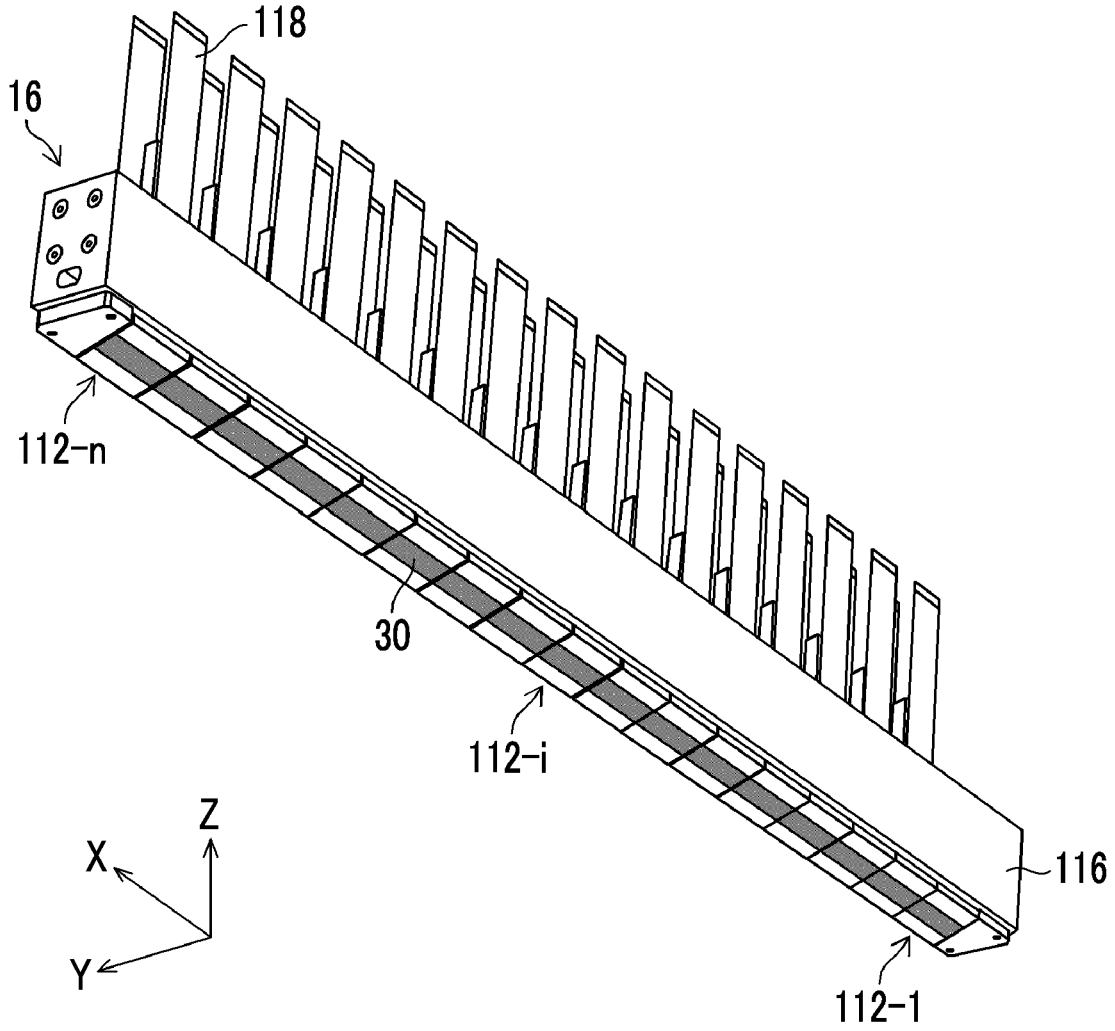
FIG. 3 is a perspective view of an ink jet head.

FIG. 3 is a perspective view of the ink jet head 16. The ink jet head 16 is configured by connecting a plurality of head modules 112-*i* (i=1, 2, . . . n) to each other in the X-direction. Herein, an example in which 17 (n=17) head modules 112-*i* are arranged is shown. A frame 116 functions as a frame for fixing the plurality of head modules 112-*i*. Each of the head modules 112-*i* is fixed to the frame 116 with the nozzle surface 30 facing the same direction. The structures of the respective head modules 112-*i* are the same.

Each of flexible substrates 118 is connected to each of the head modules 112-*i*. A drive signal, a jet control signal, and the like are supplied to each of the head modules 112-*i* via each of the flexible substrates 118.

Figure 4:
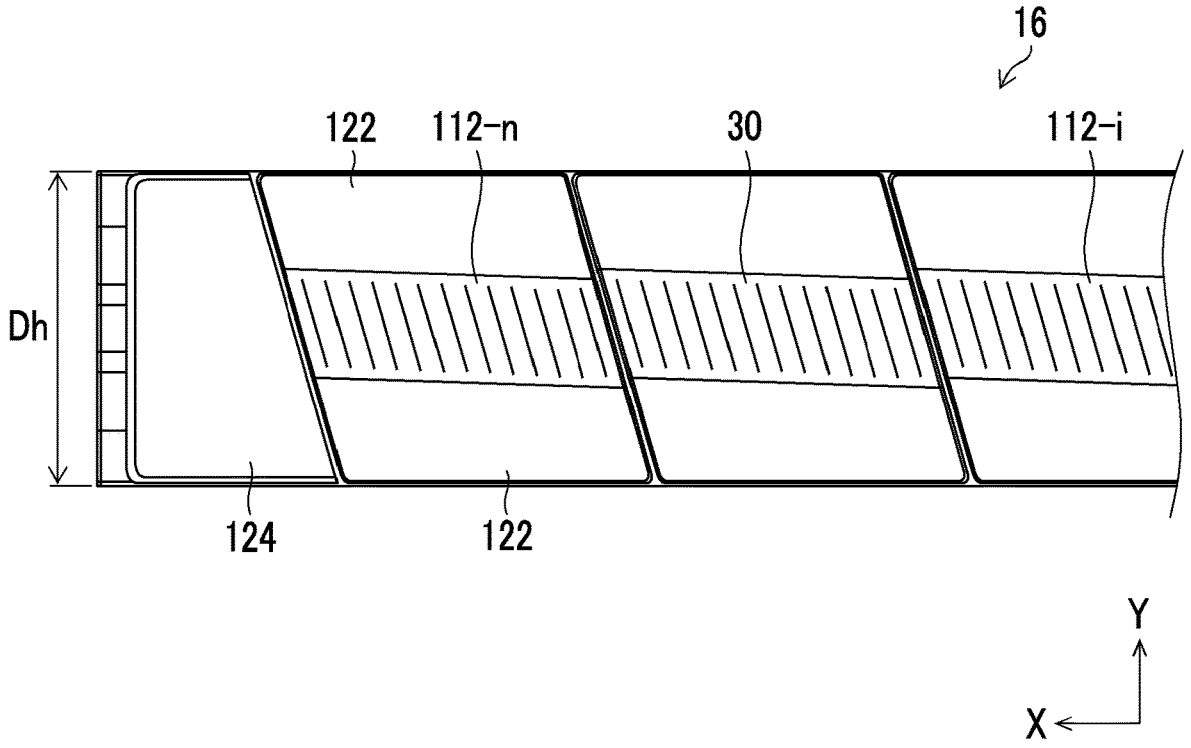
FIG. 4 is an enlarged view of the ink jet head, which is viewed from a nozzle surface side.

FIG. 4 is an enlarged view of the ink jet head 16, which is viewed from a nozzle surface 30 side. As shown in FIG. 4, the length of the ink jet head 16 in a direction orthogonal to the X-direction, which is a direction along the nozzle surface 30 (an example of a second direction), is denoted by Dh. The ink jet head 16 supports each of the head modules 112-*i* from both sides in the Y-direction with head module holding members 122. In addition, the ink jet head 16 supports a head module row consists of the plurality of head modules 112-*i* from both sides in the X-direction with head protecting members 124.

Liquid repellent processing is performed on the nozzle surface 30, and a liquid repellent film is formed thereon. Therefore, the nozzle surface 30 corresponds to a nozzle portion having liquid repellency. In addition, the liquid repellent processing is not performed on the head module holding member 122 and the head protecting member 124. Therefore, the head module holding member 122 and the head protecting member 124 correspond to a non-nozzle portion that is inferior in liquid repellency to the nozzle surface 30 or does not have liquid repellency.

Figure 5:
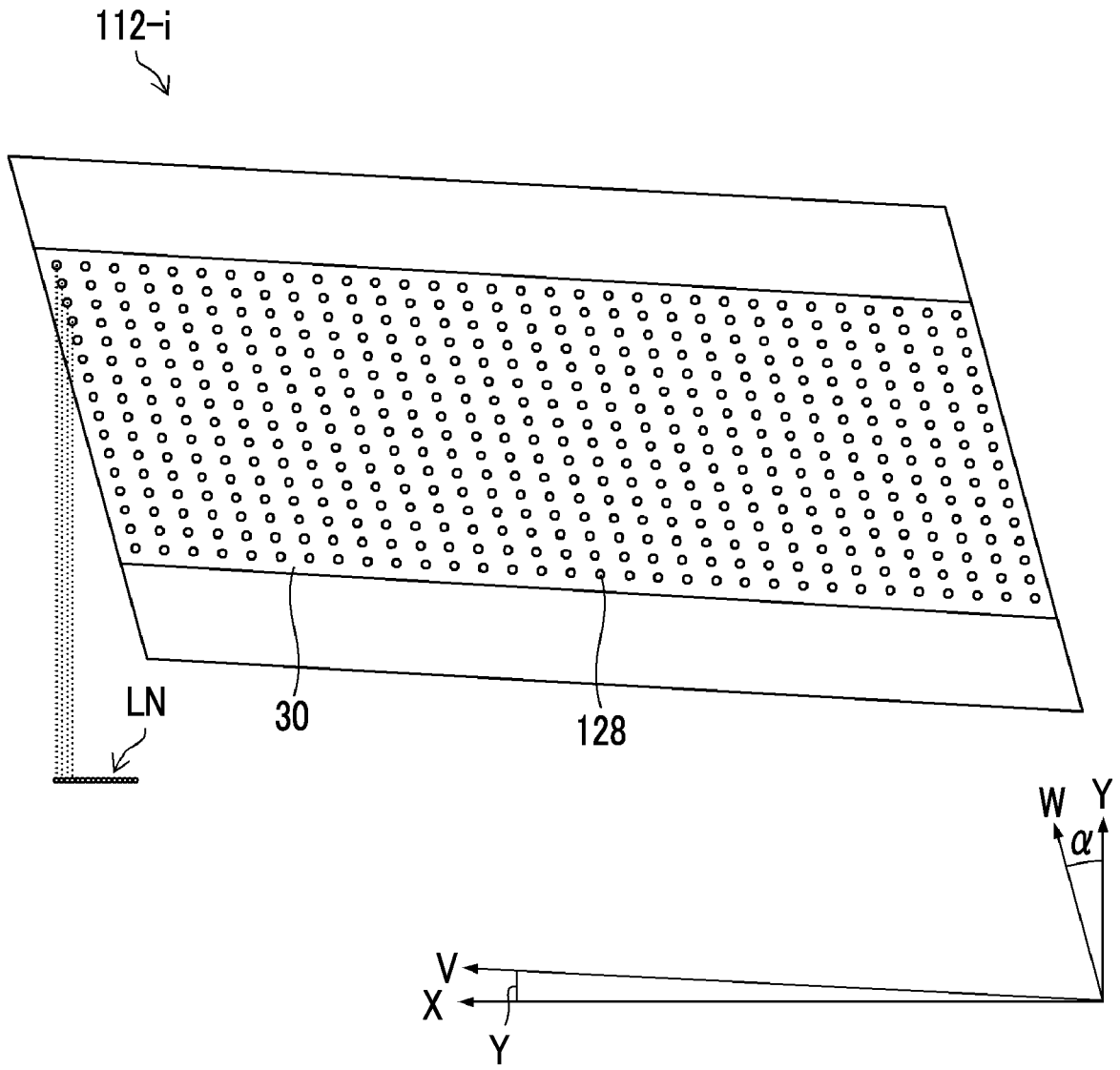
FIG. 5 is a plan view showing an example of a nozzle surface of a head module.

FIG. 5 is a plan view showing an example of the nozzle surface 30 of the head module 112-*i*. The head module 112-*i* has a parallel quadrilateral plan view shape having end surfaces on a long side along a V-direction having an inclination of an angle $\gamma$ with respect to the X-direction and end surfaces on a short side along a W-direction having an inclination of an angle $\alpha$ with respect to the Y-direction. The nozzles 128 are two-dimensionally arranged in the nozzle surface 30. The nozzles 128 have a circular shape in XY-plan view in the example shown in FIG. 5, but may have a quadrangular shape or a polygonal shape.

A projected nozzle row LN projected in the X-direction is equivalent to one nozzle row in which the nozzles 128 are arranged at equal intervals in a nozzle density that achieves recording resolution. The nozzle density of the head module 112-*i* in the X-direction is, for example, 1,200 dots per inch (dpi).

By connecting the plurality of head modules 112-*i* to each other in the X-direction (refer to FIG. 3), the nozzles 128 of the ink jet head 16 are disposed over the entire surface of the single-sheet paper 12. That is, the ink jet head 16 is a full-line type bar head capable of printing at recording resolution of 1,200 dpi in one time of transporting of the single-sheet paper 12.

The full-line type bar head applied to the single-pass method is not limited to a case where the entire surface of the single-sheet paper 12 is set as a printing range, and the nozzles may be disposed in a range necessary for printing in a case where a part of the single-sheet paper 12 is set as a printing region, such as a case where a margin portion is provided in the vicinity of the single-sheet paper 12.

The number of nozzles, the nozzle density, and a nozzle arrangement state for the head module 112-*i* are not particularly limited. The present embodiment is effective particularly for an ink jet head having nozzle density of 600 dpi or more.

<Internal Structure Example of Head Module>

The head module 112-*i* comprises a jetting energy generating element (for example, a piezoelectric element or a heat generating element), which generates jetting energy necessary for ink jetting, corresponding to each of the nozzles 128. The head module 112-*i* jets an ink on demand in accordance with a drive signal and a jet control signal which are supplied via the flexible substrate 118.

Figure 6:
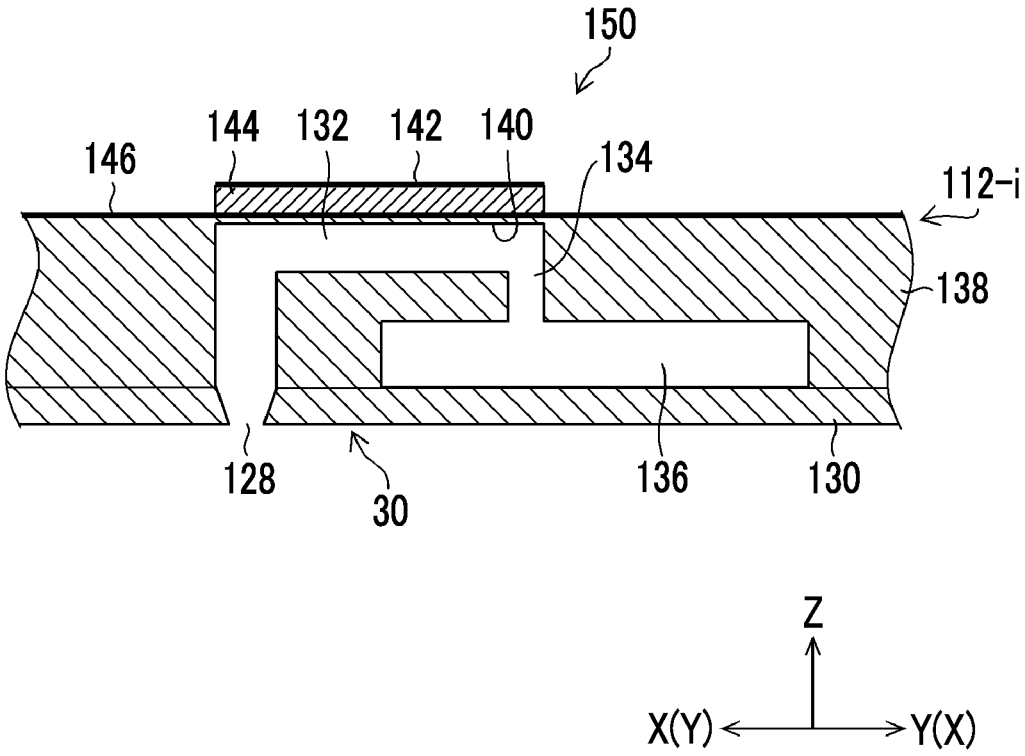
FIG. 6 is a cross sectional view showing an internal structure example of an ink droplet jetting element for one nozzle.

FIG. 6 is a cross sectional view showing an internal structure example of an ink droplet jetting element for one nozzle of the head module 112-*i*. The head module 112-*i* includes a nozzle plate 130 in which the nozzle 128, which is an ink droplet jetting port, is formed and a flow path plate 138, in which a pressure chamber 132, a supply port 134, and a flow path, such as a common flow path 136, corresponding to the nozzle 128 are formed.

The flow path plate 138 is a flow path forming member that configures a side wall portion of the pressure chamber 132 and forms the supply port 134 which is a narrowed portion (most constricted portion) of an individual supply path, through which an ink is introduced from the common flow path 136 to the pressure chamber 132. The flow path plate 138 may be configured by one substrate, or may have a structure obtained by laminating a plurality of substrates. The nozzle plate 130 and the flow path plate 138 can be processed into a required shape using a semiconductor manufacturing technique with silicon as a material.

The plurality of pressure chambers 132 are connected to the common flow path 136 via each supply port 134. In addition, the common flow path 136 communicates with an ink supply port 160 and an ink collection port 162 (refer to FIG. 7), which are provided in the ink jet head 16, and allows an ink to be circulated therein by an ink supply system 200 (refer to FIG. 7).

A piezoelectric element 144 comprising an individual electrode 142 is provided for each pressure chamber 132 at a diaphragm 140 configuring a part of a surface (a top surface in FIG. 6) of the pressure chamber 132. The diaphragm 140 is made of silicon with a conductive layer that functions as a common electrode 146 corresponding to a lower electrode of the piezoelectric element 144, and also serves as a common electrode of the piezoelectric element 144 disposed to correspond to each pressure chamber 132. An embodiment in which the diaphragm is formed of a non-conductive material, such as a resin, is possible, and in this case, a common electrode layer made of a conductive material, such as a metal, is formed on the surface of a diaphragm. In addition, the diaphragm that serves as a common electrode may be configured by a metal (a conductive material), such as stainless steel.

As a drive voltage is applied to the individual electrode 142, the piezoelectric element 144 deforms and the volume of the pressure chamber 132 changes. Due to a pressure change associated with the volume change, an ink is jetted from the nozzle 128. After ink jetting, the pressure chamber 132 is again filled with a new ink from the common flow path 136 through the supply port 134.

As a drive voltage to be applied to the individual electrode 142 is selected, the head module 112-*i* can jet any ink droplet among three types of ink droplets, including a small droplet with a relatively small ink amount from each of the nozzles 128, a medium droplet with an ink amount relatively larger than the small droplet, and a large droplet with an ink amount relatively larger than the medium droplet. In this manner, the head module 112-*i* can form a plurality of ink dots having different diameters on the single-sheet paper 12.

An ink chamber unit 150 including the nozzle 128, the pressure chamber 132, the supply port 134, and the piezoelectric element 144 is the ink droplet jetting element which is a recording element unit that records one pixel. The head module 112-*i* comprises the plurality of ink chamber units 150 corresponding to two-dimensional nozzle arrangement described in FIG. 5.

<Ink Supply System>

Figure 7:
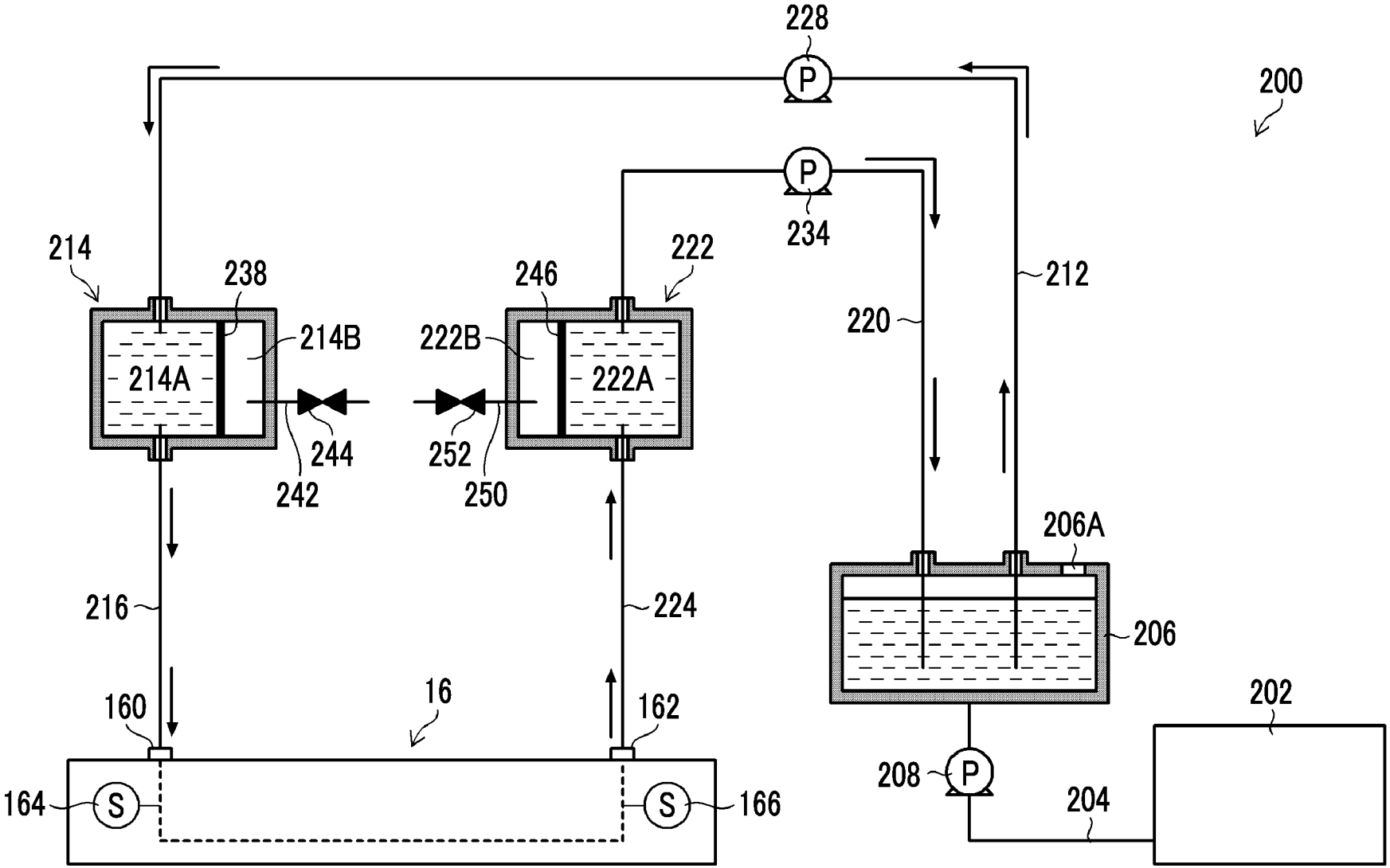
FIG. 7 is a schematic configuration diagram of an ink supply system.

FIG. 7 is a schematic configuration diagram of the ink supply system 200 that supplies an ink to the ink jet head 16. The ink supply system 200 is configured to include a main tank 202, a buffer tank 206, a main pump 208, a supply tank 214, a collecting tank 222, a supply pump 228, and a collecting pump 234.

A color ink to be jet by the ink jet head 16 is stored in the main tank 202. The ink may contain at least one of a metal pigment or carbon black. The viscosity of the ink is preferably in a range of 2 to 10 cm pores. 1 cm pore is 0.001 pascal seconds (Pa·s). In the present specification, in a case where a numerical range is represented by using " to ", the numerical range includes upper and lower limits indicated by " to ".

The main tank 202 is connected to the buffer tank 206 via a main tank connecting pipe 204. The main pump 208 is provided at the main tank connecting pipe 204. The main pump 208 sends an ink stored in the main tank 202 to the buffer tank 206.

The inside of the buffer tank 206 is open to the atmosphere via an atmospheric opening hole 206A provided in a top surface thereof. A predetermined amount of ink supplied from the main tank 202 is stored inside the buffer tank 206.

The buffer tank 206 communicates with the supply tank 214 via a first supply flow path 212. Further, the supply tank 214 communicates with the ink supply port 160 of the ink jet head 16 via a second supply flow path 216.

In addition, the buffer tank 206 communicates with the collecting tank 222 via a first collecting flow path 220. Further, the collecting tank 222 communicates with the ink collection port 162 of the ink jet head 16 via a second collecting flow path 224.

The supply pump 228 is provided at the first supply flow path 212. The supply pump 228 sends an ink from the buffer tank 206 to the supply tank 214. In addition, the collecting pump 234 is provided at the first collecting flow path 220. The collecting pump 234 sends an ink from the collecting tank 222 to the buffer tank 206.

The inside of the supply tank 214 is divided into a supply ink chamber 214A and a supply gas chamber 214B by an elastic film 238. In the supply ink chamber 214A, the first supply flow path 212 and the second supply flow path 216 communicate with each other. An ink stored in the buffer tank 206 is supplied by the supply pump 228 to the ink jet head 16 via the first supply flow path 212, the supply ink chamber 214A, and the second supply flow path 216.

On the other hand, the supply gas chamber 214B is filled with a gas. An atmospheric opening pipe 242 for opening the supply gas chamber 214B to the atmosphere communicates with the supply gas chamber 214B. An atmospheric opening valve 244 is provided at the atmospheric opening pipe 242. The atmospheric opening valve 244 opens and closes the atmospheric opening pipe 242.

The configuration of the collecting tank 222 is also the same. That is, the inside of the collecting tank 222 is divided into a collecting ink chamber 222A and a collecting gas chamber 222B by an elastic film 246.

In the collecting ink chamber 222A, the first collecting flow path 220 and the second collecting flow path 224 communicate with each other. An ink inside the ink jet head 16 is collected by the collecting pump 234 into the buffer tank 206 via the second collecting flow path 224, the collecting ink chamber 222A, and the first collecting flow path 220.

The collecting gas chamber 222B is filled with a gas. An atmospheric opening pipe 250 for opening the collecting gas chamber 222B to the atmosphere communicates with the collecting gas chamber 222B. An atmospheric opening valve 252 is provided at the atmospheric opening pipe 250. The atmospheric opening valve 252 operates in response to a command from a control device and opens and closes the atmospheric opening pipe 250.

<Configuration of Nozzle Surface Cleaning Device>

As shown in FIG. 2, the nozzle surface cleaning device 60 is configured by a cleaning liquid applying portion 62 that cleans the nozzle surfaces 30C, 30M, 30Y, and 30K of the ink jet heads 16C, 16M, 16Y, and 16K by applying a cleaning liquid thereto and a wiping portion 64 that wipes the nozzle surfaces 30C, 30M, 30Y, and 30K to which the cleaning liquid is applied. The nozzle surface cleaning device 60 is disposed on a movement path of the head supporting frame 40.

The nozzle surface cleaning device 60 (an example of a recording head cleaning device) cleans the nozzle surfaces 30C, 30M, 30Y, and 30K by moving the ink jet heads 16C, 16M, 16Y, and 16K from the maintenance position to the image recording position, or from the image recording position to the maintenance position (an example of relative movement).

The wiping portion 64 is disposed on an image recording position side with respect to the cleaning liquid applying portion 62 in the example shown in FIG. 2, but may be disposed on a maintenance position side with respect to the cleaning liquid applying portion 62.

<Configuration of Cleaning Liquid Applying Portion>

Figure 8:
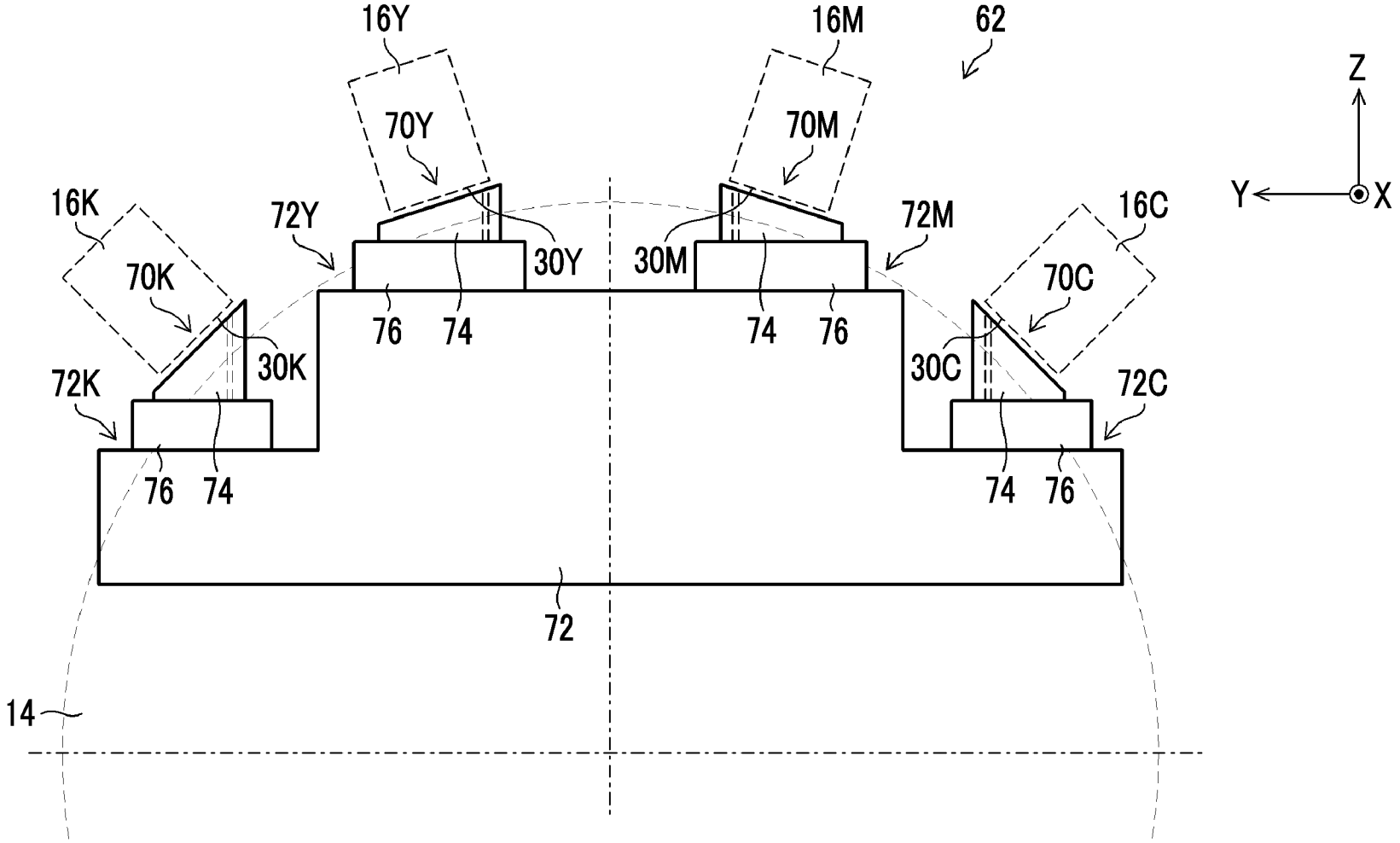
FIG. 8 is a side view of a cleaning liquid applying portion.

FIG. 8 is a side view of the cleaning liquid applying portion 62, which is viewed from the maintenance position side. The cleaning liquid applying portion 62 is provided on the inside of the waste liquid tray 54 included in the moisturizing unit 50 (refer to FIG. 2). The cleaning liquid applying portion 62 is configured to comprise cleaning liquid applying units 70C, 70M, 70Y, and 70K which are provided to correspond to the ink jet heads 16C, 16M, 16Y, and 16K respectively, and a main body 72 on which the cleaning liquid applying units 70C, 70M, 70Y, and 70K are mounted.

The main body 72 is provided horizontally and is freely lifted and lowered by a lifting and lowering device (not shown). The main body 72 has cleaning liquid applying unit attaching portions 72C, 72M, 72Y, and 72K on an upper portion. The cleaning liquid applying units 70C, 70M, 70Y, and 70K are fixed to the cleaning liquid applying unit attaching portions 72C, 72M, 72Y, and 72K provided in the main body 72 by a bolt and the like, and are disposed on movement paths of the ink jet heads 16C, 16M, 16Y, and 16K corresponding thereto.

Figure 9:
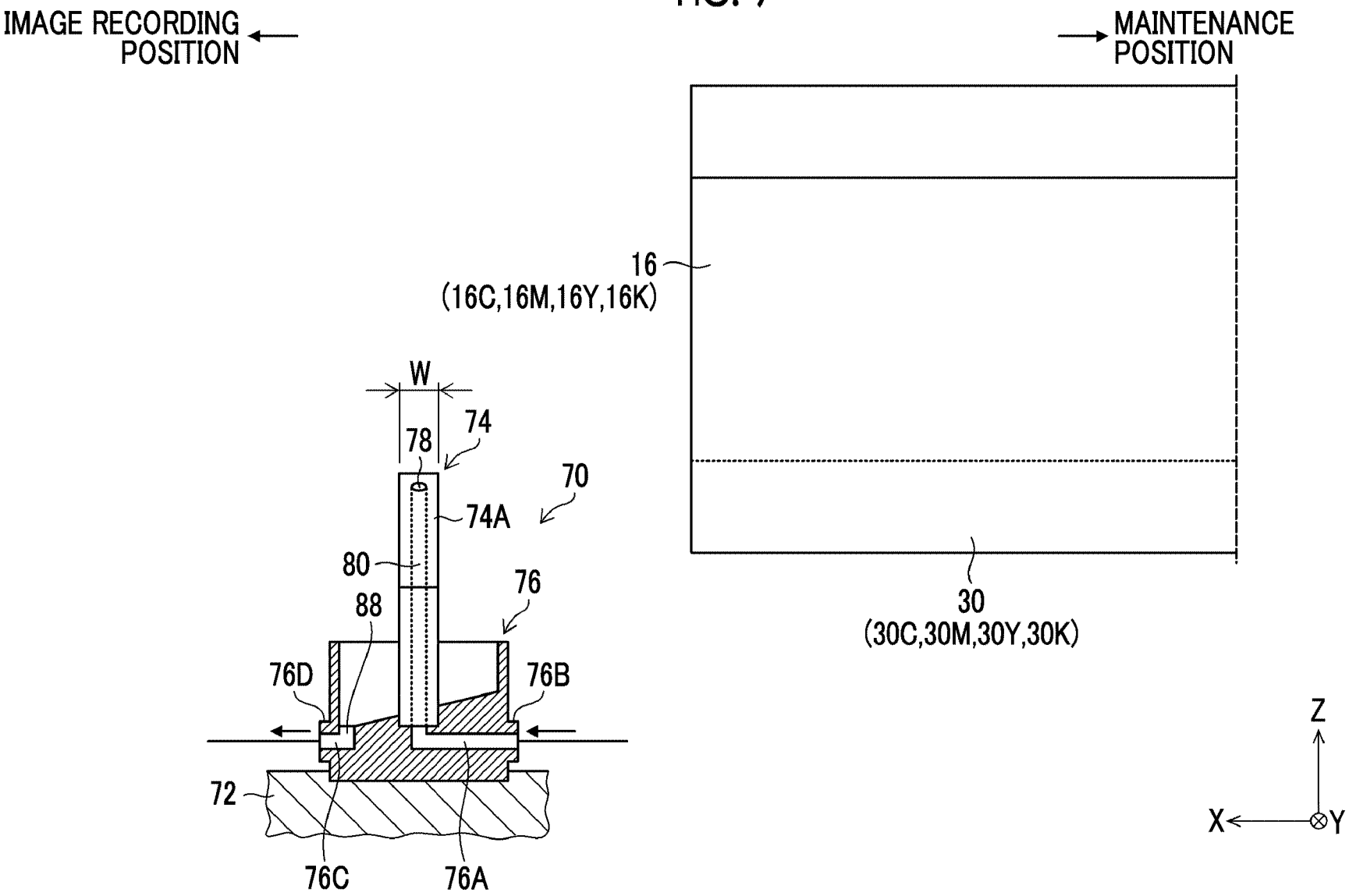
FIG. 9 is a front view of a cleaning liquid applying unit.
Figure 10:
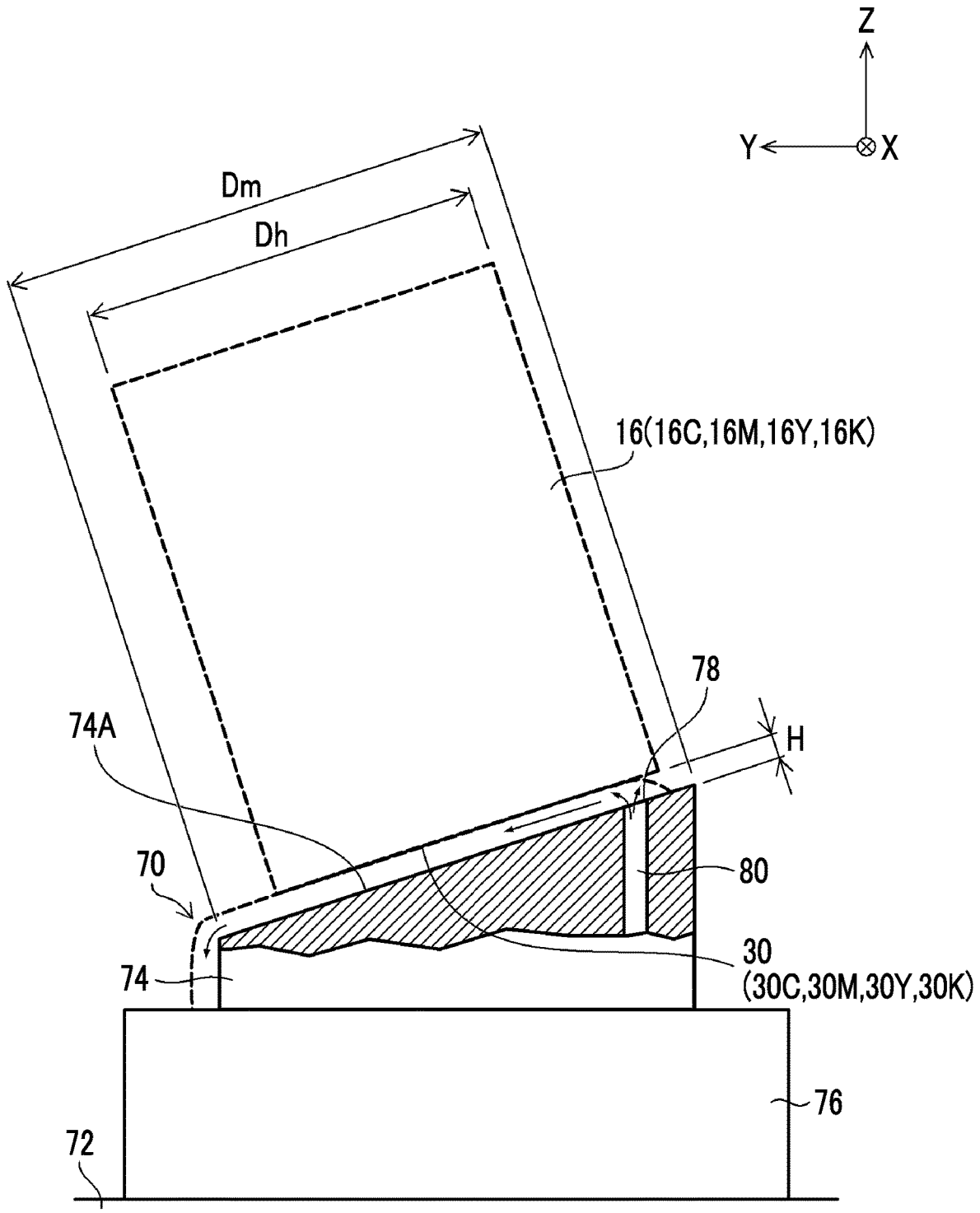
FIG. 10 is a side view of the cleaning liquid applying unit.

Since the basic configurations of the cleaning liquid applying units 70C, 70M, 70Y, and 70K are the same, the configuration of the cleaning liquid applying unit 70 will be described herein. FIGS. 9 and 10 are a front view and a side view of the cleaning liquid applying unit 70, respectively. As shown in FIGS. 9 and 10, the cleaning liquid applying unit 70 is configured to comprise a cleaning liquid applying head 74 that applies a cleaning liquid to the nozzle surface 30 and a cleaning liquid collecting dish 76 that collects the cleaning liquid that falls from the nozzle surface 30.

The cleaning liquid collecting dish 76 has a rectangular box shape with an open upper portion. The cleaning liquid applying head 74 is vertically erected inside the cleaning liquid collecting dish 76.

The cleaning liquid applying head 74 (an example of a cleaning liquid holding unit) has a square block shape, and comprises a cleaning liquid holding surface 74A tilted with respect to a horizontal surface at an upper portion. The cleaning liquid holding surface 74A has the same tilt angle as the nozzle surface 30 of the ink jet head 16, which is a cleaning target.

The cleaning liquid applying head 74 cleans the nozzle surface 30 facing the cleaning liquid holding surface 74A with a cleaning liquid held by the cleaning liquid holding surface 74A. The cleaning liquid holding surface 74A has a rectangular shape of which a length in the X-direction (an example of a first direction) is W and a length in the direction orthogonal to the X-direction, which is direction along the cleaning liquid holding surface 74A (an example of a second direction), is Dm that is larger than Dh. That is, a relationship of Dm>Dh is satisfied.

In a case of cleaning the nozzle surface 30, the entire nozzle surface 30 faces the cleaning liquid holding surface 74A. In addition, an interval (distance) between the nozzle surface 30 and the cleaning liquid holding surface 74A in a case where the nozzle surface 30 and the cleaning liquid holding surface 74A face each other is H.

Further, a cleaning liquid spurting port 78 from which a cleaning liquid is spurted is disposed at a position facing the head module holding member 122 in a case where the nozzle surface 30 and the cleaning liquid holding surface 74A face each other, which is near the upper portion of the cleaning liquid holding surface 74A in a tilting direction. The cleaning liquid spurted from the cleaning liquid spurting port 78 flows and falls from the tilted cleaning liquid holding surface 74A. Accordingly, a layer (film) of cleaning liquid is formed on the cleaning liquid holding surface 74A. By bringing the nozzle surface 30 of the ink jet head 16 into contact with the layer of cleaning liquid formed on the cleaning liquid holding surface 74A, the cleaning liquid is applied to the nozzle surface 30, and the nozzle surface 30 is cleaned with the applied cleaning liquid.

The cleaning liquid applying head 74 has a supply flow path 80 that communicates with the cleaning liquid spurting port 78. The supply flow path 80 communicates with a communication flow path 76A provided in the cleaning liquid collecting dish 76. The communication flow path 76A communicates with a cleaning liquid supply port 76B provided in the cleaning liquid collecting dish 76. As a cleaning liquid is supplied to the cleaning liquid supply port 76B, the cleaning liquid applying head 74 spurts the cleaning liquid from the cleaning liquid spurting port 78.

A cleaning liquid is supplied from a cleaning liquid tank (not shown) to the cleaning liquid supply port 76B. A pipe (not shown) connected to the cleaning liquid tank is connected to the cleaning liquid supply port 76B. A cleaning liquid supply pump (not shown) and a valve (not shown) are provided at the pipe. In a case where the valve is opened and the cleaning liquid supply pump is driven, the cleaning liquid is supplied from the cleaning liquid tank to the cleaning liquid applying head 74.

In addition, a bottom portion of the cleaning liquid collecting dish 76 has a tilt with respect to the horizontal surface, and has a collecting hole 88 in a lower end portion in the tilting direction. The collecting hole 88 communicates with a cleaning liquid discharge port 76D via a collecting flow path 76C. The cleaning liquid discharge port 76D is connected to the waste liquid tank 58 (refer to FIG. 2) via a pipe (not shown). A cleaning liquid spurted from the cleaning liquid spurting port 78 of the cleaning liquid applying head 74 flows and falls from the cleaning liquid holding surface 74A so as to be collected in the cleaning liquid collecting dish 76, and is collected in the waste liquid tank 58 via the pipe (not shown).

Although a cleaning liquid is supplied to the cleaning liquid holding surface 74A by spurting the cleaning liquid from the cleaning liquid spurting port 78 disposed in the cleaning liquid holding surface 74A herein, a method of supplying the cleaning liquid is not limited thereto. For example, the cleaning liquid may be supplied by dropping the cleaning liquid near the upper portion of the cleaning liquid holding surface 74A in the tilting direction from a separately provided cleaning liquid nozzle.

As a cleaning liquid, for example, a cleaning liquid containing diethylene monobutyl ether as a main component is used. By applying this type of cleaning liquid to the nozzle surface 30, it is possible to dissolve and easily remove an ink-derived adhered matter adhered to the nozzle surface 30.

<Configuration of Wiping Portion>

Figure 11:
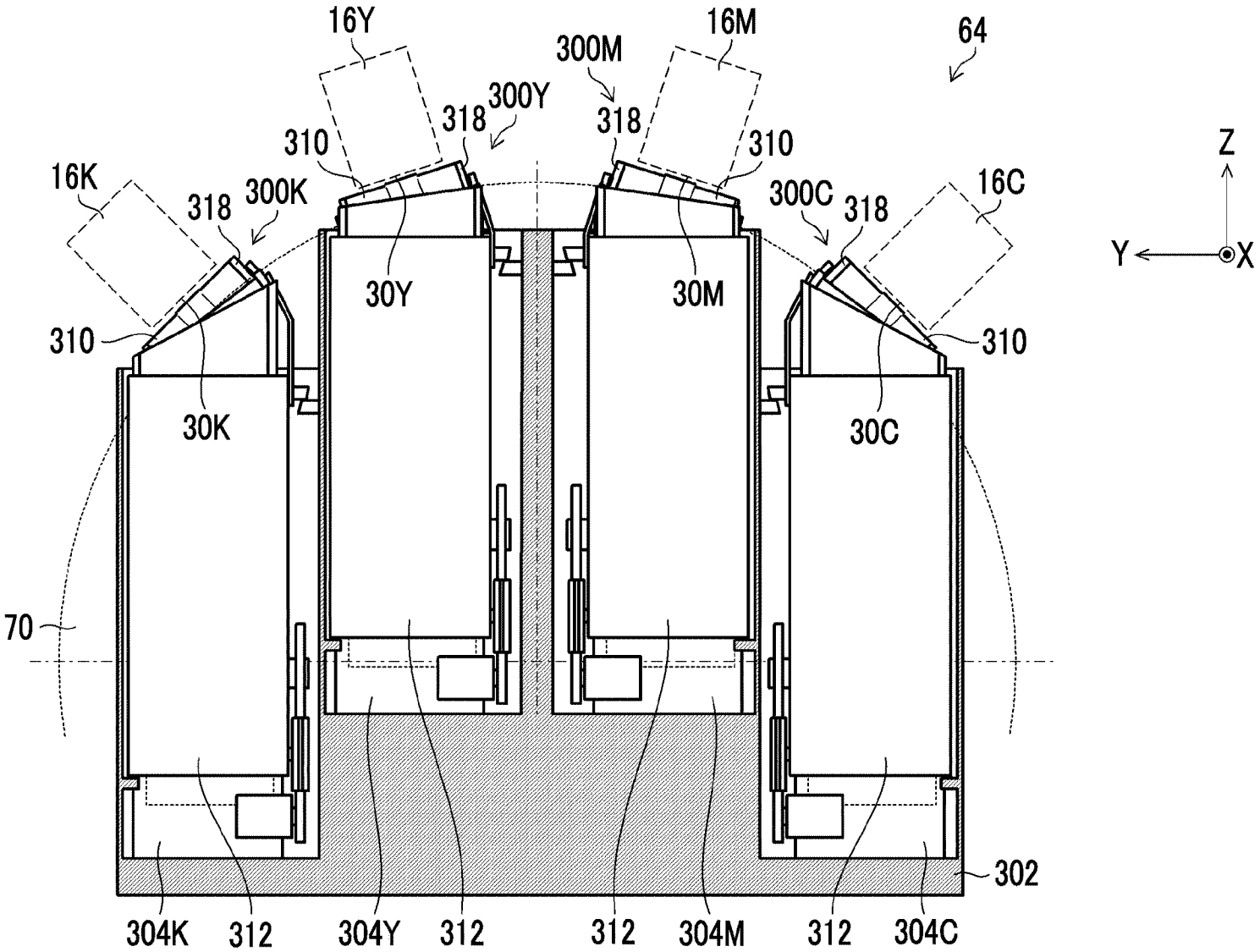
FIG. 11 is a side view of a wiping portion, which is viewed from a maintenance position side.

FIG. 11 is a side view of the wiping portion, which is viewed from the maintenance position side. As shown in FIG. 11, the wiping portion 64 is configured to comprise wiping units 300C, 300M, 300Y, and 300K which are provided to correspond to the ink jet heads 16C, 16M, 16Y, and 16K, and a main body frame 302 on which the wiping units 300C, 300M, 300Y, and 300K are set.

<Configuration of Main Body Frame>

The main body frame 302 has a box shape of which an upper end portion is open. The main body frame 302 is provided horizontally and is freely lifted and lowered by the lifting and lowering device (not shown). Inside the main body frame 302, wiping unit mounting portions 304C, 304M, 304Y, and 304K for mounting the wiping units 300C, 300M, 300Y, and 300K are provided.

The wiping unit mounting portions 304C, 304M, 304Y, and 304K are spaces that can accommodate the wiping units 300C, 300M, 300Y, and 300K, and upper portions thereof are open. By being inserted vertically downward from upper opening portions of the wiping unit mounting portions 304C, 304M, 304Y, and 304K, the wiping units 300C, 300M, 300Y, and 300K are set on the wiping unit mounting portions 304C, 304M, 304Y, and 304K.

The wiping unit mounting portions 304C, 304M, 304Y, and 304K each comprise a lock mechanism (not shown), and the wiping units 300C, 300M, 300Y, and 300K mounted by the lock mechanisms are locked. In a case where the wiping units 300C, 300M, 300Y, and 300K are inserted into the wiping unit mounting portions 304C, 304M, 304Y, and 304K, the lock mechanisms operate automatically.

<Configuration of Wiping Unit>

Since the basic configurations of the wiping units 300C, 300M, 300Y, and 300K are the same, the configuration of the wiping unit 300 will be described herein.

Figure 12:
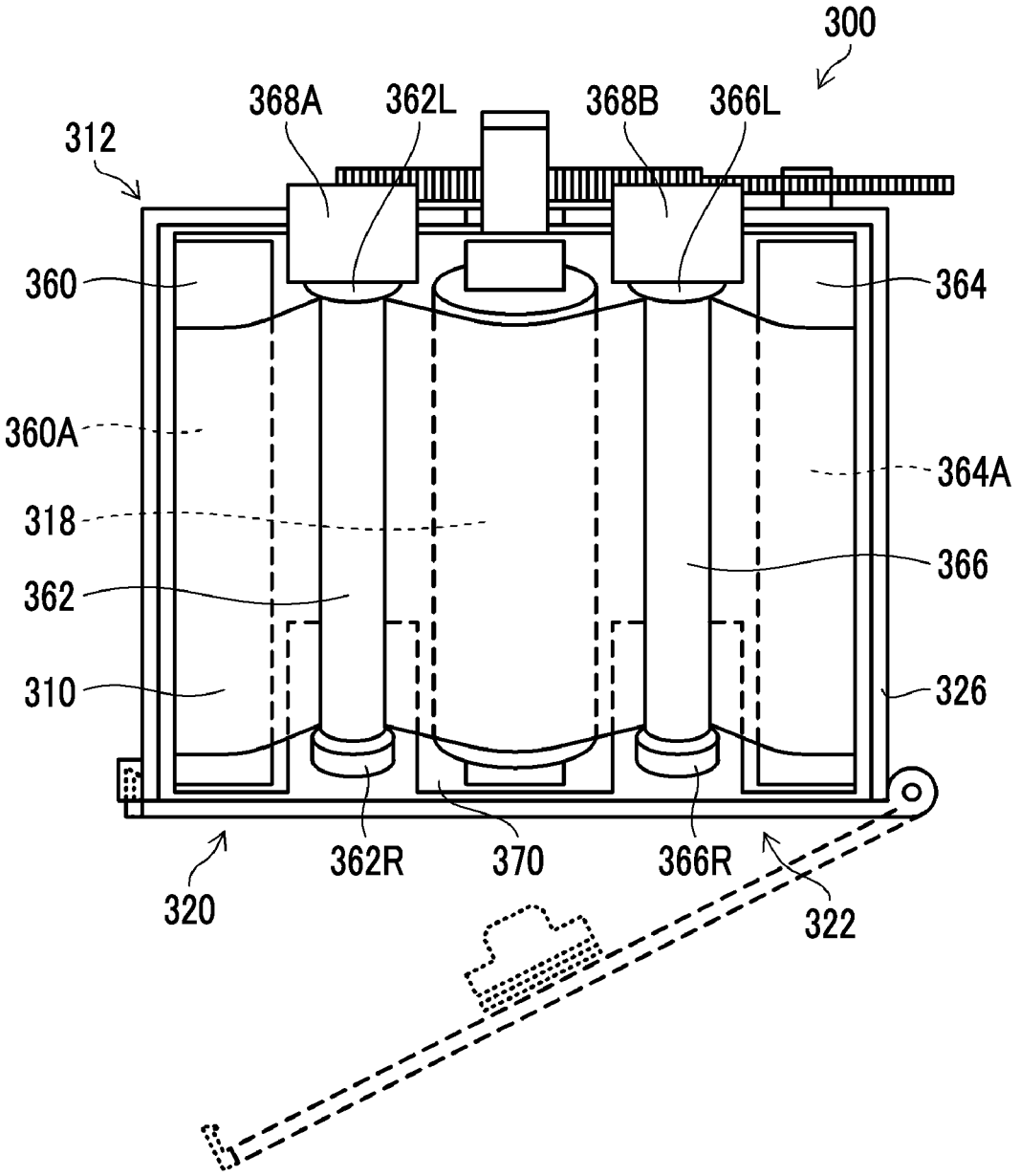
FIG. 12 is a plan view of a wiping unit.
Figure 13:
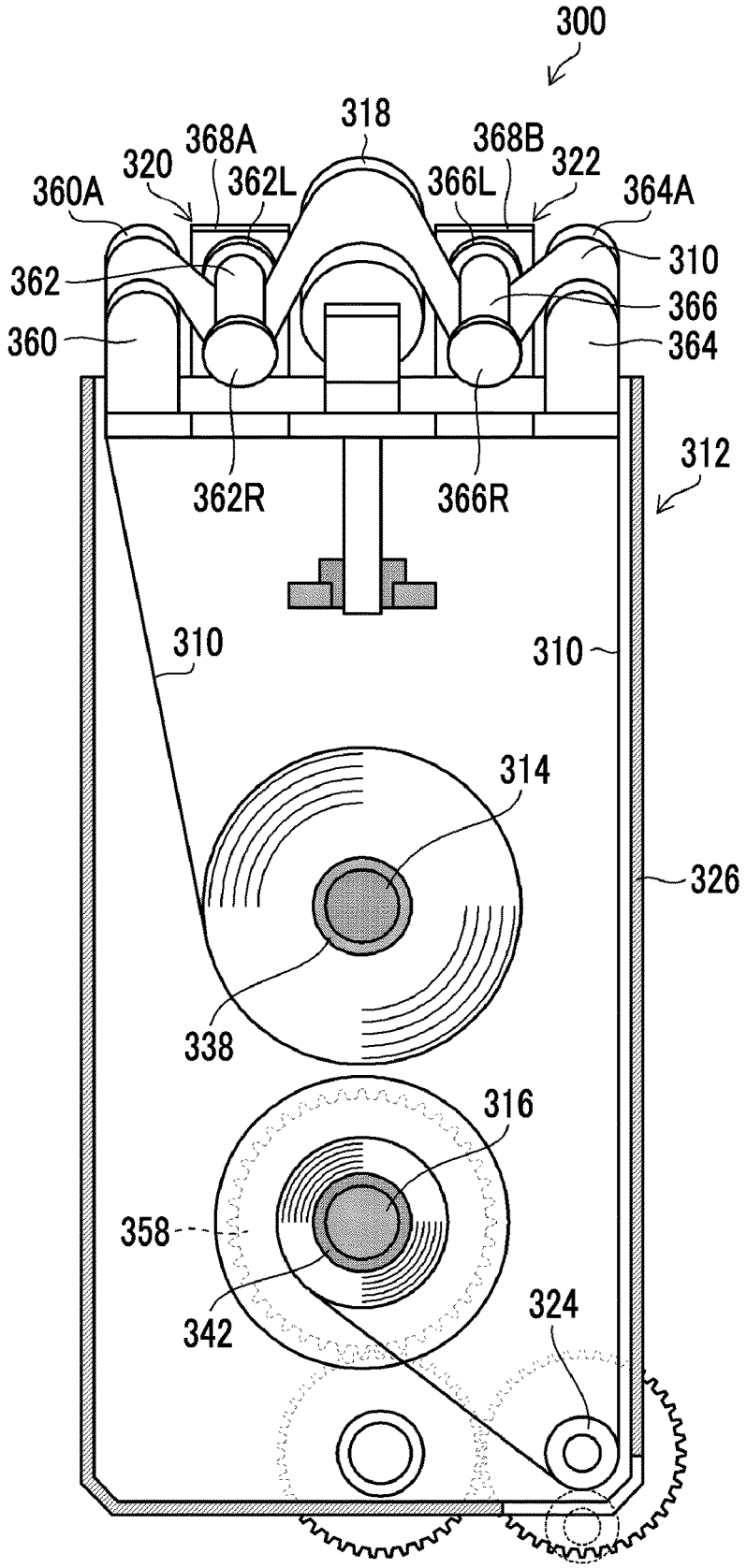
FIG. 13 is a cross sectional view of a front portion of the wiping unit.

FIG. 12 is a plan view of the wiping unit, and FIG. 13 is a cross sectional view of a front portion of the wiping unit. As shown in FIGS. 12 and 13, the wiping unit 300 wipes the nozzle surface 30 as a strip-shaped wiping web 310 (an example of a wiping member) is wound around a pressing roller 318 which is provided in a tilted manner and the wiping web 310 wound around the pressing roller 318 is pressed and abuts against the nozzle surface 30 (refer to FIG. 3) of the ink jet head 16. In the present embodiment, the wiping unit 300 wipes the nozzle surface 30 with the wiping web 310 which is in a dry state where a cleaning liquid is not allowed to be infiltrated.

The wiping unit 300 is configured to comprise a case 312, a feeding shaft 314 that feeds the wiping web 310, a rolling shaft 316 that rolls the wiping web 310, a front guide 320 that guides the wiping web 310 fed from the feeding shaft 314 to be wound around the pressing roller 318, a rear guide 322 that guides the wiping web 310 wound around the pressing roller 318 to be rolled by the rolling shaft 316, and a grid roller (drive roller) 324 that transports the wiping web 310.

The feeding shaft 314 has a cylindrical shape. The feeding shaft 314 is fixed (cantilever-supported) to a pivotally supporting unit of which a base end portion is provided at a case main body 326, and is horizontally provided inside the case main body 326. A feeding core 338 is attachably and detachably mounted on the feeding shaft 314. The feeding shaft 314 is slightly shorter than the length of the feeding core 338. Therefore, in a case where the feeding core 338 is mounted, the feeding shaft 314 retracts to an inner circumferential portion of the feeding core 338.

The feeding core 338 has a cylindrical shape. The strip-shaped wiping web 310 is wound around the feeding core 338 in a roll shape.

The feeding core 338 is mounted on the feeding shaft 314 as the feeding shaft 314 is inserted into the inner circumferential portion and is fitted to the feeding shaft 314. The feeding core 338 mounted on the feeding shaft 314 rotates around the feeding shaft 314 and is rotatably supported.

The wiping web 310 is configured by, for example, a sheet consists of knitting or weaving formed of ultrafine fibers such as polyethylene terephthalate (PET), polyethylene (PE), and nylon (NY). The wiping web 310 has a width corresponding to the width of the ink jet head 16, which is a wiping target.

The rolling shaft 316 is horizontally provided at a position below the feeding shaft 314. That is, the rolling shaft 316 and the feeding shaft 314 are disposed to be juxtaposed vertically.

A rolling core 342 that rolls the wiping web 310 fed from the feeding core 338 is mounted on the rolling shaft 316.

The configuration of the rolling core 342 is almost the same as the configuration of the feeding core 338. That is, the rolling core 342 has a cylindrical shape. A leading end of the wiping web 310 wound around the feeding core 338 is fixed to the rolling core 342.

The rolling core 342 is mounted on the rolling shaft 316 as the rolling shaft 316 is fitted to an inner circumferential portion.

A main shaft, which is the rolling shaft 316, is provided such that a base end portion protrudes to an outer side of the case main body 326, and a rolling shaft gear 358 is attached to the protruding base end portion. The rolling shaft 316 (the main shaft) rotates as the rolling shaft gear 358 is rotationally driven by a motor (not shown).

The pressing roller 318 is disposed above the feeding shaft 314 (in the present example, the pressing roller 318, the feeding shaft 314, and the rolling shaft 316 are disposed on the same line), and is disposed to be tilted at a predetermined angle with respect to the horizontal surface. That is, since the pressing roller 318 causes the wiping web 310 to be pressed and abutted against the nozzle surface 30 of the ink jet head 16, the pressing roller is disposed to be inclined in accordance with a tilt with respect to the horizontal surface of the nozzle surface 30 of the ink jet head 16, which is a wiping target, and the pressing roller 318 and the nozzle surface 30 are disposed to be parallel to each other.

The front guide 320 is configured by a first front guide 360 and a second front guide 362, and guides the wiping web 310 fed from the feeding shaft 314 to be wound around the pressing roller 318 provided in a tilted manner.

On the other hand, the rear guide 322 is configured by a first rear guide 364 and a second rear guide 366, and guides the wiping web 310 wound around the pressing roller 318 provided in a tilted manner to be rolled by the rolling shaft 316 which is horizontally provided.

The front guide 320 and the rear guide 322 are symmetrically disposed with the pressing roller 318 interposed therebetween. That is, the first front guide 360 and the first rear guide 364 are disposed symmetrically with the pressing roller 318 interposed therebetween, and the second front guide 362 and the second rear guide 366 are disposed symmetrically with the pressing roller 318 interposed therebetween.

The first front guide 360 has a plate shape having a predetermined width, and is vertically erected on a lifting and lowering stage 370. The first front guide 360 has an upper edge portion 360A which is a wound portion of the wiping web 310, and has an arc shape on the surface. In addition, the upper edge portion 360A is tilted at a predetermined angle with respect to the horizontal surface. Accordingly, a traveling direction of the wiping web 310 is converted.

The first rear guide 364 has the same configuration as the first front guide 360. That is, the first rear guide has a plate shape having a predetermined width, and is vertically erected on the lifting and lowering stage 370. The first rear guide 364 has an upper edge portion 364A which is a wound portion of the wiping web 310, and has an arc shape. In addition, the upper edge portion 364A is tilted at a predetermined angle with respect to the horizontal surface.

The first front guide 360 and the first rear guide 364 are symmetrically disposed with the pressing roller 318 interposed therebetween. By being wound around the first front guide 360, the wiping web 310 fed from the feeding shaft 314 changes a direction from a direction orthogonal to the feeding shaft 314 to a direction substantially orthogonal to the pressing roller 318. In addition, by being wound around the first rear guide 364, the wiping web 310 wound around the second rear guide 366 changes a direction to a direction orthogonal to the rolling shaft 316.

The second front guide 362 is configured as a guide roller that has flanges 362L and 362R at both end portions. The second front guide 362 is disposed between the first front guide 360 and the pressing roller 318, and guides the wiping web 310 wound around the first front guide 360 to be wound around the pressing roller 318. That is, the traveling direction of the wiping web 310 is finely adjusted such that the wiping web 310, which has changed a direction to the direction substantially orthogonal to the pressing roller 318 by the first front guide 360, travels in a direction orthogonal to the pressing roller 318. In addition, the flanges 362L and 362R at both ends prevent the wiping web 310 from skewing.

The second front guide 362 is provided in a tilted manner at a predetermined angle as one end thereof is cantilever-supported by a bracket 368A. As shown in FIG. 12, the bracket 368A has a plate shape whose tip is bent, and a base end portion thereof is fixed to a rear surface upper end portion of the case main body 326. The bracket 368A is provided to vertically protrude upward from the upper end portion of the case main body 326. The second front guide 362 is supported to be movable rotationally by being cantilever-supported by a bent portion of the tip of the bracket 368A.

The second rear guide 366 has the same configuration as the second front guide 362. That is, the second rear guide 366 is configured as a guide roller having flanges 366L and 366R at both end portions, and is provided in a tilted manner at a predetermined angle as one end thereof is cantilever-supported by a bracket 368B. The bracket 368B has a plate shape whose tip is bent, and a base end portion thereof is fixed to the rear surface upper end portion of the case main body 326. The second rear guide 366 is supported to be movable rotationally by being cantilever-supported by a bent portion of the tip of the bracket 368B.

The second rear guide 366 is disposed between the pressing roller 318 and the first rear guide 364, and guides the wiping web 310 wound around the pressing roller 318 to be wound around the first rear guide 364.

The second front guide 362 and the second rear guide 366 are symmetrically disposed with the pressing roller 318 interposed therebetween. The traveling direction is finely adjusted such that the wiping web 310, which has changed a direction to the direction substantially orthogonal to the pressing roller 318 by the first front guide 360, is wound around the second front guide 362 to travel in the direction orthogonal to the pressing roller 318. In addition, the traveling direction is finely adjusted by the second rear guide 366 such that the wiping web 310 wound around the pressing roller 318 is wound around the first rear guide 364. By being wound around the first rear guide 364, the wiping web 310 changes a direction to the direction orthogonal to the rolling shaft 316.

In this manner, by switching the traveling direction of the wiping web 310 step by step, the front guide 320 and the rear guide 322 guide the wiping web 310 to be wound around the pressing roller 318 without difficulty.

For this reason, the tilt angle of the second front guide 362 is an angle close to the tilt angle of the pressing roller 318 compared to the tilt angle of the first front guide 360. Similarly, the tilt angle of the second rear guide 366 is an angle close to the tilt angle of the pressing roller 318 compared to the tilt angle of the first rear guide 364.

<Electric Configuration of Image Recording Unit>

Figure 14:
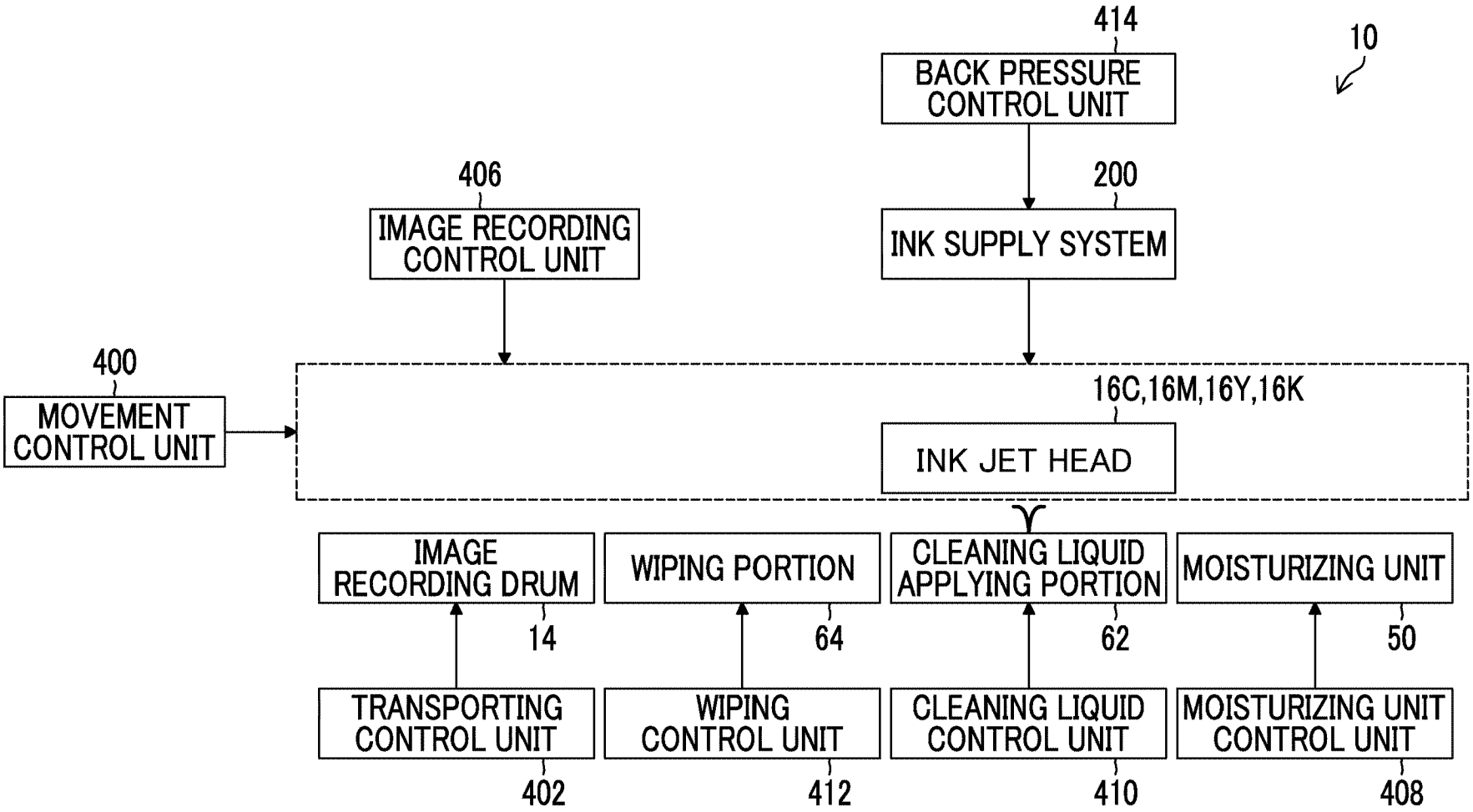
FIG. 14 is a block diagram showing an electric configuration of the image recording unit.

FIG. 14 is a block diagram showing an electric configuration of the image recording unit 10. The image recording unit 10 is configured to comprise a movement control unit 400, a transporting control unit 402, an image recording control unit 406, a moisturizing unit control unit 408, a cleaning liquid control unit 410, a wiping control unit 412, and a back pressure control unit 414.

The movement control unit 400 (an example of a movement unit) controls the movement of the ink jet heads 16C, 16M, 16Y, and 16K. The movement control unit 400 drives the linear drive mechanism (not shown) to move the ink jet heads 16C, 16M, 16Y, and 16K supported by the head supporting frame 40 between the image recording position and the maintenance position (refer to FIG. 2).

The transporting control unit 402 controls the transporting of the single-sheet paper 12. The transporting control unit 402 controls the grippers 24 (refer to FIG. 1), and causes the grippers 24 to grip the leading end portion of the single-sheet paper 12. In addition, the transporting control unit 402 controls the suction holding mechanism (not shown), and causes the outer circumferential surface of the image recording drum 14 to hold the single-sheet paper 12. Further, the transporting control unit 402 drives the motor (not shown) to rotate the image recording drum 14, and causes the single-sheet paper 12 to be held and transported by the image recording drum 14.

In addition, the transporting control unit 402 drives the transporting drum 26 and the transporting drum 28 (refer to FIG. 1) to transport the single-sheet paper 12 from the transporting drum 26 to the image recording drum 14, and further from the image recording drum 14 to the transporting drum 28.

The image recording control unit 406 controls the ink jet heads 16C, 16M, 16Y, and 16K. The image recording control unit 406 causes ink droplets to be jetted from the ink jet heads 16C, 16M, 16Y, and 16K, and records a color image on the surface of the single-sheet paper 12 transported by the image recording drum 14.

The moisturizing unit control unit 408 controls the moisturizing unit 50 to moisturize the ink jet heads 16C, 16M, 16Y, and 16K. The moisturizing unit control unit 408 controls the pressurizing mechanism (not shown) and the suction mechanism (not shown) to perform pressurizing and suction of the nozzles 128 of the ink jet heads 16C, 16M, 16Y, and 16K from the caps 52C, 52M, 52Y, and 52K. The moisturizing unit control unit 408 controls the cleaning liquid supply mechanism (not shown) to supply a cleaning liquid into the caps 52C, 52M, 52Y, and 52K.

The cleaning liquid control unit 410 controls the cleaning liquid applying portion 62 to apply a cleaning liquid to the nozzle surfaces 30C, 30M, 30Y, and 30K of the ink jet heads 16C, 16M, 16Y, and 16K. The cleaning liquid control unit 410 raises the main body 72 (refer to FIG. 8) by a predetermined amount and moves the main body from a standby position to an operating position. In addition, the cleaning liquid control unit 410 drives the cleaning liquid supply pump (not shown) to spurt the cleaning liquid from the cleaning liquid spurting port 78 of the cleaning liquid applying head 74.

The wiping control unit 412 controls the wiping portion 64 to wipe the nozzle surfaces 30C, 30M, 30Y, and 30K of the ink jet heads 16C, 16M, 16Y, and 16K with the wiping web 310. The wiping control unit 412 causes the lifting and lowering device (not shown) to move the main body frame 302 from the standby position to the operating position. The wiping control unit 412 drives the motor (not shown) to rotate the rolling shaft 316 (refer to FIG. 13), causing the wiping web 310 to travel.

The back pressure control unit 414 controls the ink supply system 200 provided for an ink of each color, and circulates the ink in each ink jet head 16. The back pressure control unit 414 causes a supply side pressure sensor 164 and a collection side pressure sensor 166 (refer to FIG. 7), which are provided in the ink jet head 16, to measure the pressure (back pressure) of the ink jet head 16, and controls the driving of the supply pump 228 and the collecting pump 234 based on the measurement results.

For example, in a case of recording an image using the ink jet head 16, a supply side pressure Pin caused by the supply pump 228 and a collection side pressure Pout caused by the collecting pump 234 are set to negative pressures respectively such that Pin>Pout is satisfied. That is, the supply side pressure of the supply pump 228 is a negative pressure but the collection side pressure of the collecting pump 234 is a negative pressure which is further lower pressure. Thus, an ink flows from the ink supply port 160 to the ink collection port 162, and a back pressure Pn of the nozzle 128 of the ink jet head 16 is maintained at a negative pressure. Therefore, the nozzle 128 of the head module 112-*i* circulates the ink in the ink jet head 16 while holding the meniscus of the ink.

<Ink Jet Head Cleaning Method>

Figure 15:
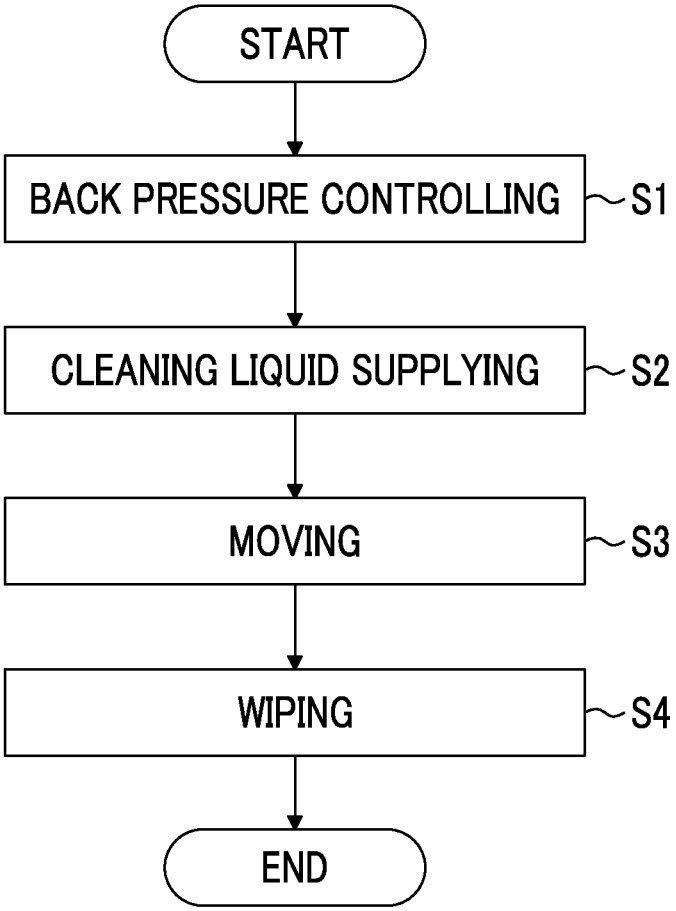
FIG. 15 is a flowchart showing processing of an ink jet head cleaning method.

FIG. 15 is a flowchart showing processing of an ink jet head cleaning method. The ink jet head cleaning method comprises a back pressure controlling step (Step S1), a cleaning liquid supplying step (Step S2), a moving step (Step S3), and a wiping step (Step S4).

Herein, the nozzle surfaces 30C, 30M, 30Y, and 30K of the ink jet heads 16C, 16M, 16Y, and 16K are covered with the caps 52C, 52M, 52Y, and 52K at the maintenance position. In this maintenance state, the back pressure control unit 414 performs control such that the back pressures of the nozzles 128 of the ink jet heads 16C, 16M, 16Y, and 16K become back pressures for maintenance. Herein, the back pressure control unit 414 sets the back pressures of the nozzles 128 to −1,000 pascals. The back pressure for maintenance may be −1,100 pascals to −900 pascals.

In a case where the cleaning of the ink jet heads 16C, 16M, 16Y, and 16K starts, in Step S1, the back pressure control unit 414 sets the back pressures of the nozzles 128 of the ink jet heads 16C, 16M, 16Y, and 16K to a back pressure for nozzle surface cleaning.

In Step S2, the cleaning liquid control unit 410 raises the main body 72 (refer to FIG. 8) by a predetermined amount and moves the main body from the standby position to the operating position. Further, the cleaning liquid control unit 410 drives the cleaning liquid supply pump (not shown) to spurt a cleaning liquid from the cleaning liquid spurting port 78 of the cleaning liquid applying head 74, and to apply the cleaning liquid to the cleaning liquid holding surface 74A (an example of a cleaning liquid applying step).

In Step S3, the movement control unit 400 (an example of a cleaning unit) moves the ink jet heads 16C, 16M, 16Y, and 16K toward the image recording position. In a case where the ink jet heads 16C, 16M, 16Y, and 16K reach the cleaning liquid applying portion 62, the nozzle surfaces 30C, 30M, 30Y, and 30K of the ink jet heads 16C, 16M, 16Y, and 16K face the cleaning liquid holding surfaces 74A of the cleaning liquid applying units 70C, 70M, 70Y, and 70K. Accordingly, the nozzle surfaces 30C, 30M, 30Y, and 30K are cleaned with a cleaning liquid held by the cleaning liquid holding surfaces 74A (an example of a cleaning step).

As described above, each cleaning liquid holding surface 74A has a length in the X-direction denoted by W and a length in the direction along the cleaning liquid holding surface 74A, which is the direction orthogonal to the X-direction, denoted by Dm. In addition, the length of each of the ink jet heads 16C, 16M, 16Y, and 16K in the direction orthogonal to the X-direction, which is the direction along the nozzle surface 30, is denoted by Dh. Therefore, the cleaning liquid control unit 410 applies a larger amount of cleaning liquid than W×Dh×H to each space. For example, the cleaning liquid is applied at a flow speed of W×Dh×H per second. Accordingly, a space between each of the nozzle surfaces 30C, 30M, 30Y, and 30K and each cleaning liquid holding surface 74A thereof is in a state filled with the cleaning liquid, and thus the nozzle surfaces 30C, 30M, 30Y, and 30K can be appropriately cleaned.

Herein, as the back pressures of the nozzles 128 of the ink jet heads 16C, 16M, 16Y, and 16K are set to the back pressure for nozzle surface cleaning, a cleaning liquid can be prevented from entering the inside of the nozzles 128 in a case of cleaning with the cleaning liquid.

Further, the movement control unit 400 moves the ink jet heads 16C, 16M, 16Y, and 16K to the image recording position. Therefore, all of the nozzle surfaces 30C, 30M, 30Y, and 30K face the cleaning liquid holding surfaces 74A respectively in a process of reaching the image recording position, and are cleaned with a cleaning liquid.

In a case where the movement control unit 400 causes the ink jet heads 16C, 16M, 16Y, and 16K to reach the image recording position, the cleaning liquid control unit 410 stops the supply of a cleaning liquid from the cleaning liquid spurting port 78, and moves the main body 72 to the standby position. In addition, the movement control unit 400 moves the ink jet heads 16C, 16M, 16Y, and 16K to the maintenance position again.

In Step S4, the back pressure control unit 414 sets the back pressures of the nozzles 128 of the ink jet heads 16C, 16M, 16Y, and 16K to −2,000 pascals, which is a back pressure for wiping. The back pressure for wiping may be −2,100 pascals to −1,900 pascals. In addition, the wiping control unit 412 moves the main body frame 302 from the standby position to the operating position, causing the wiping web 310 to travel.

Further, the movement control unit 400 moves the ink jet heads 16C, 16M, 16Y, and 16K from the maintenance position to the image recording position. Accordingly, the nozzle surfaces 30C, 30M, 30Y, and 30K of the ink jet heads 16C, 16M, 16Y, and 16K are wiped by the wiping web 310.

Herein, as the back pressures of the nozzles 128 of the ink jet heads 16C, 16M, 16Y, and 16K are set to −2,000 pascals, which is the back pressure for wiping, an ink can be prevented from being drawn out from the nozzles 128 in a case where the dried wiping web 310 wipes the nozzle surfaces 30C, 30M, 30Y, and 30K.

In a case where the movement control unit 400 causes the ink jet heads 16C, 16M, 16Y, and 16K to reach the image recording position, the wiping control unit 412 stops the traveling of the wiping web 310, and moves the main body frame 302 to the standby position.

With the above, the cleaning of the ink jet heads 16C, 16M, 16Y, and 16K is terminated. In a case of performing image recording at the image recording position, the back pressure control unit 414 sets the back pressures of the nozzles 128 of the ink jet heads 16C, 16M, 16Y, and 16K to −1,000 pascals, which is a back pressure for image recording. The back pressure for image recording may be −1,100 pascals to −900 pascals. Accordingly, it is possible to prevent the meniscus of the nozzles 128 from overflowing.

In the ink jet head cleaning method according to the present embodiment, after a cleaning liquid is applied to the nozzle surfaces 30C, 30M, 30Y, and 30K by the cleaning liquid applying portion 62, the nozzle surfaces 30C, 30M, 30Y, and 30K are wiped by the wiping portion 64, but the wiping is not essential.

In addition, both of the cleaning liquid application and the wiping may be performed with one time of movement of the ink jet heads 16C, 16M, 16Y, and 16K from the maintenance position to the image recording position. In this case, it is preferable to control the head modules 112-*i* to which a cleaning liquid is applied by the cleaning liquid applying portion 62 and the head modules 112-*i* wiped by the wiping portion 64 at the back pressure for nozzle surface cleaning and the back pressure for wiping, respectively.

<Back Pressure of Nozzle for Nozzle Surface Cleaning>

A back pressure at which a cleaning liquid can be prevented from entering the inside of the nozzles 128 in a case of cleaning the nozzle surface 30 with the cleaning liquid was acquired through an experiment. Herein, the entering of the cleaning liquid into the nozzles 128 was estimated from a jetting deterioration level after the cleaning of the nozzle surface 30 and the proportion of defective nozzles.

Herein, the length W of the cleaning liquid holding surface 74A in the X-direction was set to 15 millimeters, the length Dm of the cleaning liquid holding surface 74A in the direction orthogonal to the X-direction was set to 50 millimeters, the length Dh of the ink jet head 16 in the direction orthogonal to the X-direction was set to 43.5 millimeters, and the interval H between the nozzle surface 30 and the cleaning liquid holding surface 74A was set to 1.5 millimeters. A volume V of a space between the nozzle surface 30 and the cleaning liquid holding surface 74A, which face each other, is approximately 979 cubic millimeters.

In addition, the experiment was performed under a condition in which the nozzle surface 30 and the cleaning liquid holding surface 74A are inclined in a Z-direction by 8 degrees with respect to the horizontal surface. A supply amount Vm of a cleaning liquid was set to 1,000 cubic millimeters/second. The space between the nozzle surface 30 and the cleaning liquid holding surface 74A was filled with the cleaning liquid at all times.

In addition, after the cleaning liquid applying portion 62 applied a cleaning liquid to the nozzle surface 30, wiping was performed by the wiping portion 64. The back pressure during wiping was set to −2,000 pascals.

Figure 16:
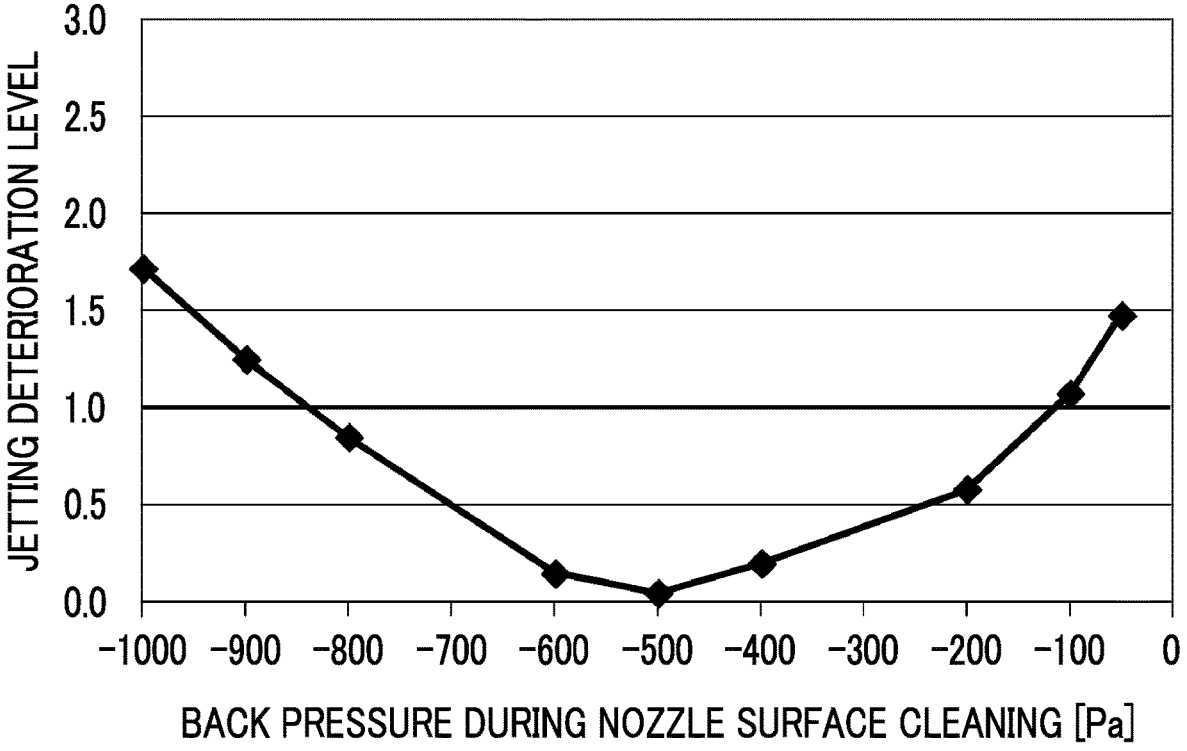
FIG. 16 is a graph showing a relationship between a back pressure of a nozzle during nozzle surface cleaning and a jetting deterioration level of the nozzle immediately after the nozzle surface cleaning.

FIG. 16 is a graph showing a relationship between the back pressures of the nozzles 128 during the cleaning of the nozzle surface 30 and the jetting deterioration levels of the nozzles 128 immediately after the cleaning of the nozzle surface 30. The jetting deterioration levels of the nozzles 128 were acquired from a difference in landing position variations before and after the cleaning of the nozzle surface 30, and were quantified based on the following standards.

1.0: a fail level since a streak is visible in a case of solid printing 0.5: a pass level since a jetting performance is deteriorated but a streak is not visible or is not easily visible 0.25: a pass level since both of the deterioration of a jetting performance and a streak are not visible As shown in FIG. 16, the back pressures of the nozzles 128 within a range where a jetting deterioration level was acceptable, that is, the back pressures of the nozzles 128 having a jetting deterioration level less than 1.0 were −840 pascals to −120 pascals.

Figure 17:
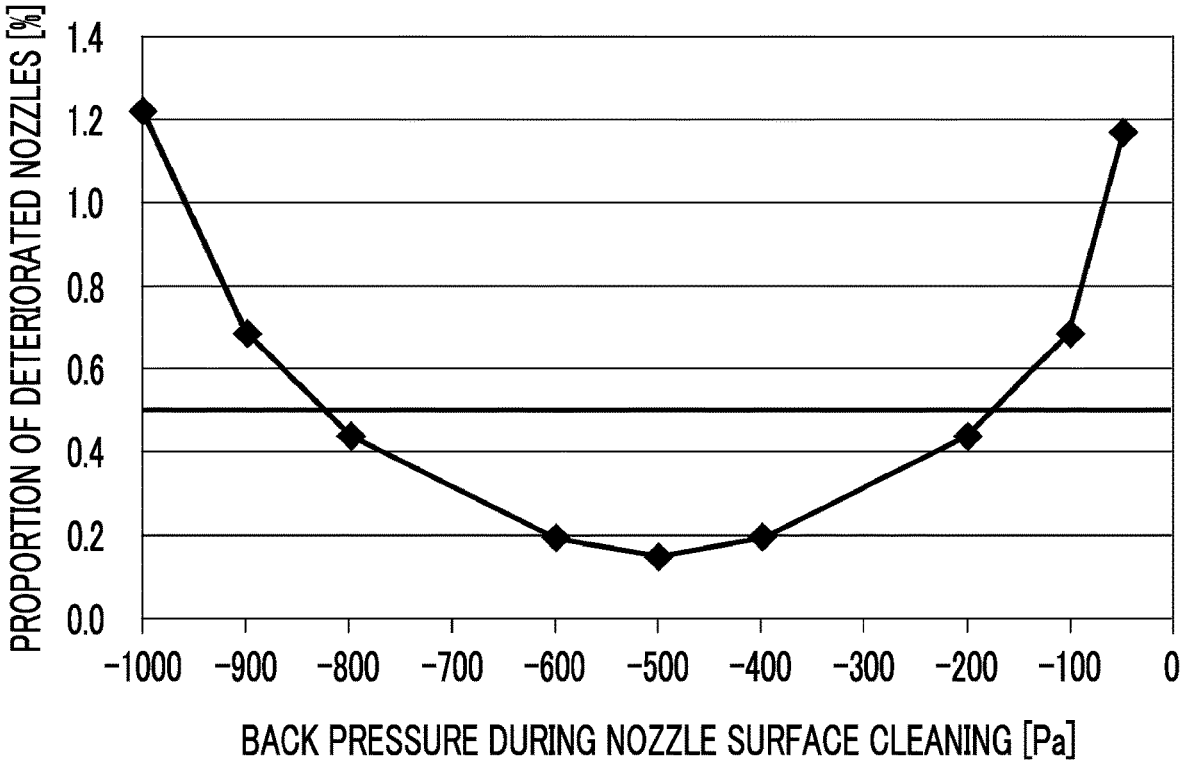
FIG. 17 is a graph showing a relationship between the back pressure of the nozzle during the nozzle surface cleaning and a proportion of defective nozzles whose jetting performances have deteriorated immediately after the nozzle surface cleaning.

FIG. 17 is a graph showing a relationship between the back pressures of the nozzles 128 during the cleaning of the nozzle surface 30 and the proportion of defective nozzles whose jetting performances were deteriorated immediately after the cleaning of the nozzle surface 30. The proportion of the nozzles 128 whose jetting performances were deteriorated was calculated by counting the number of the nozzles 128, in which jetting bending of 15 micrometers or more that caused a streak occurred, and the non-jetting nozzles 128, from which an ink was not jetted, and dividing the counted number by the number of all the nozzles 128, in a case where a solid image having a coverage exceeding 100% was recorded on the single-sheet paper 12. In a case where an upper limit of the proportion of acceptable defective nozzles was set to 0.5 percents, the back pressures of the nozzles 128 satisfying the standard were −820 pascals to −180 pascals.

Therefore, it was found that the back pressures of the nozzles 128 satisfying both standards of the jetting deterioration levels of the nozzles 128 immediately after the cleaning of the nozzle surface 30 and the proportion of defective nozzles were −820 pascals to −180 pascals.

In the present embodiment, the back pressure control unit 414 sets the back pressures of the nozzles 128 of the ink jet heads 16C, 16M, 16Y, and 16K to −800 pascals to −200 pascals during cleaning liquid application. The back pressure control unit 414 preferably sets the back pressures of the nozzles 128 to −700 pascals to −300 pascals, and more preferably sets the back pressures to −600 pascals to −400 pascals, during cleaning liquid application.

In a range where the tilt of each of the nozzle surface 30 and the cleaning liquid holding surface 74A with respect to the horizontal surface is within a range of 0 degree to 24 degrees, there is almost no difference in the amount of cleaning liquid necessary for filling the space. More preferably, as the tilt of each of the nozzle surface 30 and the cleaning liquid holding surface 74A with respect to the horizontal surface increases, the amount of cleaning liquid may be increased.

<Relationship Between Number of Times of Wiping and Jetting Deterioration Level>

As described above, it is found that a jetting performance can be maintained by setting the appropriate back pressure for cleaning and wiping of the nozzle surface 30 for each of the ink jet heads 16C, 16M, 16Y, and 16K that jet cyan, magenta, yellow, and black ink droplets, respectively.

However, in the ink jet head 16 that jets an ink containing a pigment which is relatively harder than the pigments of these inks, there is a possibility that damage is given to the liquid repellent processing of the nozzle surface 30 due to the hard pigment in a case of wiping. Therefore, regarding the ink jet head 16 that jets an ink containing at least one of a metal pigment or carbon black, an effect of applying a cleaning liquid during wiping by the wiping portion 64 was investigated.

Herein, a preliminary jet (dummy jet) of 20,000 shots was performed from each of the nozzles 128 at the maintenance position, and after the preliminary jet, wiping was performed by the wiping web 310 which was dried by moving from the maintenance position to the image recording position. This was set as one time of wiping.

As the ink jet head 16 to be wiped, the ink jet head 16 jetting a white ink containing 8 percent of a titanium oxide pigment having a grain diameter of approximately 200 nanometers and the ink jet head 16 jetting a black ink containing carbon black were used.

In addition, evaluation of each of the ink jet heads 16 was made in a case where wiping was performed without applying a cleaning liquid after the preliminary jet and a case where after the preliminary jet, the cleaning liquid was applied by the cleaning liquid applying portion 62 and then wiping was performed. The condition of cleaning liquid application was the same as the case used in the description of FIGS. 16 and 17.

Figure 18:
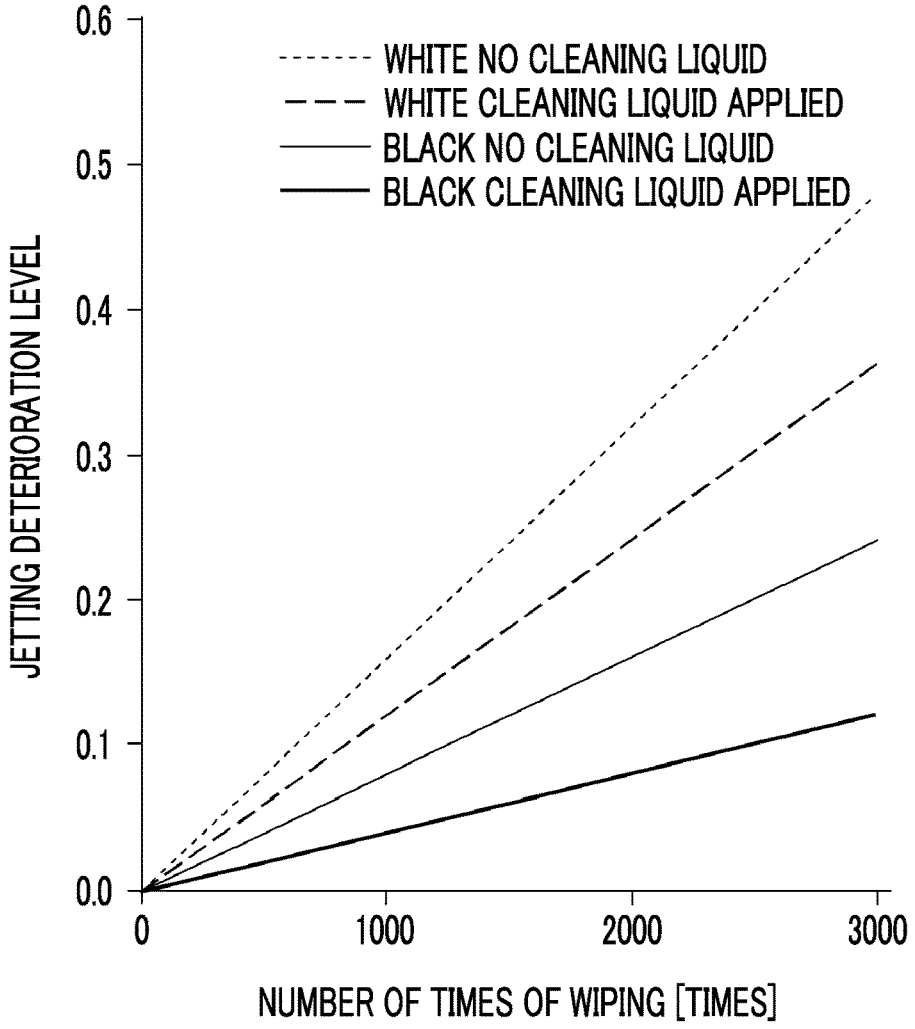
FIG. 18 is a graph showing a relationship between the number of times the nozzle surface is wiped and the jetting deterioration level.

FIG. 18 is a graph showing a relationship between the number of times the nozzle surface 30 was wiped and the jetting deterioration level. The evaluation standards of the jetting deterioration level were the same as the case of FIG. 16. As shown in FIG. 18, for the ink jet head 16 for the white ink and the ink jet head 16 for the black ink, a jetting deterioration level under the condition in which the cleaning liquid was applied was lower than a jetting deterioration level under the condition in which a cleaning liquid was not applied.

Figure 19:
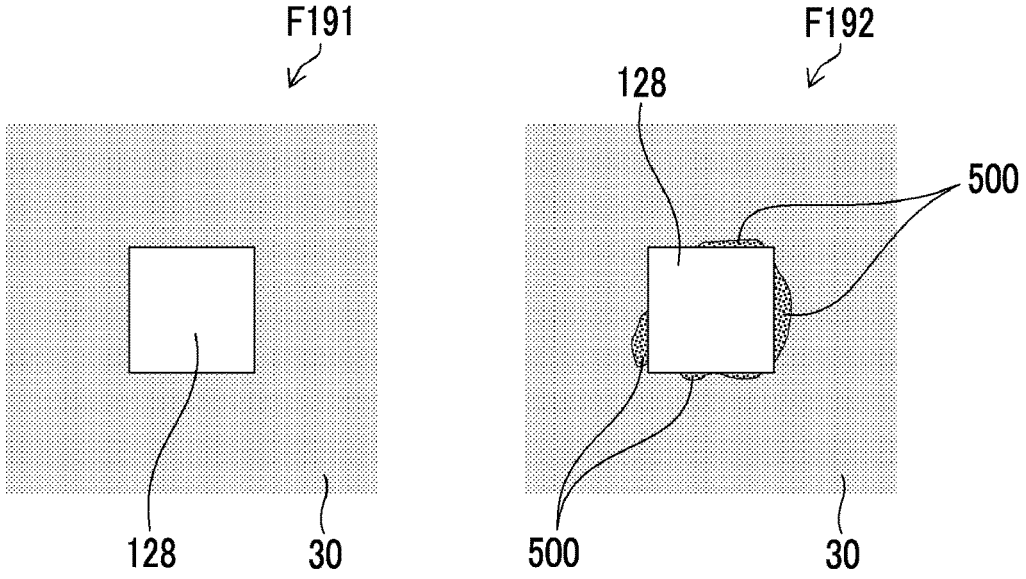
FIG. 19 is a schematic view of the nozzle for describing damage to a liquid repellent film.

FIG. 19 is a schematic view of the nozzle 128 for describing damage to the liquid repellent film of the nozzle surface 30. Herein, the quadrangular nozzle 128 is shown. The nozzle 128 indicated by F191 was in a normal state. On the other hand, the nozzle 128 indicated by F192 was in a state where damage 500 (peeling) occurred in the liquid repellent film of the nozzle surface 30. As described above, in a case where the damage 500 occurred in the liquid repellent film near the nozzle 128, jetting bending or the like occurred, and thus the jetting performance deteriorated.

For the ink jet head 16 for the white ink, the number of the nozzles 128 in which damage occurred in the liquid repellent film of the nozzle surface 30 after 3,000 times of wiping was 0.2 percents of the number of all the nozzles 128, under the condition in which the cleaning liquid was applied. On the other hand, under the condition in which the cleaning liquid was not applied, damage occurred in approximately 80 percents of the nozzles 128.

As described above, it was found that in the ink jet head 16 jetting an ink containing at least one of a metal pigment or carbon black, the metal pigment and the carbon black adhered to the nozzle surface 30 could be removed by applying a cleaning liquid before wiping the nozzle surface 30, and thus damage to the liquid repellent film of the nozzle surface 30 caused by the wiping could be reduced.

Others

It is also possible to configure the recording head cleaning method as a program for realizing each step by a computer, and to configure a non-temporary recording medium such as a compact disk-read only memory (CD-ROM) storing the program.

In the embodiment described hereinbefore, for example, a hardware structure of a processing unit, which executes various types of processing of the image recording unit 10, includes various types of processors as follows. The various types of processors include a central processing unit (CPU) that is a general-purpose processor which executes software (program) and functions as various types of processing units, a graphics processing unit (GPU) that is a processor specialized in image processing, and a dedicated electric circuit or the like that is a processor having a dedicated circuit configuration designed to execute certain processing, such as a programmable logic device (PLD) and an application specific integrated circuit (ASIC) which are processors of which a circuit configuration can be changed after manufacturing a field programmable gate array (FPGA) or the like.

One processing unit may be configured by one of the various types of processors, or may be configured by the same type or different types of two or more processors (for example, a plurality of FPGAs, a combination of a CPU and an FPGA, or a combination of a CPU and a GPU). In addition, a plurality of processing units may be configured by one processor. As an example of configuring a plurality of processing units by one processor, first, there is a form in which one processor is configured by a combination of one or more CPUs and software and the processor functions as the plurality of processing units, as represented by a computer such as a server and a client. Second, there is a form in which a processor that realizes functions of the entire system including a plurality of processing units with one integrated circuit (IC) chip is used, as represented by a system on chip (SoC) or the like. As described above, the various types of processing units are configured using one or more of the various types of processors as a hardware structure.

Further, the hardware structure of the various types of processors is, more specifically, an electric circuit (circuitry) in which circuit elements such as semiconductor elements are combined.

The technical scope of the present invention is not limited to the scope described in the embodiment. The configuration and the like in each embodiment can be combined between the embodiments as appropriate without departing from the gist of the present invention.

EXPLANATION OF REFERENCES

10: image recording unit
12: single-sheet paper
14: image recording drum
16: ink jet head
16C: ink jet head
16K: ink jet head
16M: ink jet head
16Y: ink jet head
18: rotary shaft
20: main body frame
22: bearing
24: gripper
26: transporting drum
28: transporting drum
30: nozzle surface
30C: nozzle surface
30K: nozzle surface
30M: nozzle surface
30Y: nozzle surface
40: head supporting frame
42L: side plate
42R: side plate
44: connecting frame
46C: attaching portion
46K: attaching portion
46M: attaching portion
46Y: attaching portion
48C: attached portion
48K: attached portion
48M: attached portion
48Y: attached portion
50: moisturizing unit
52C: cap
52K: cap
52M: cap
52Y: cap
54: waste liquid tray
56: waste liquid collecting pipe

58: waste liquid tank
60: nozzle surface cleaning device
62: cleaning liquid applying portion
64: wiping portion
70: cleaning liquid applying unit
70C: cleaning liquid applying unit
70K: cleaning liquid applying unit
70M: cleaning liquid applying unit
70Y: cleaning liquid applying unit
72: main body
72C: cleaning liquid applying unit attaching portion
72K: cleaning liquid applying unit attaching portion
72M: cleaning liquid applying unit attaching portion
72Y: cleaning liquid applying unit attaching portion
74: cleaning liquid applying head
74A: cleaning liquid holding surface
76: cleaning liquid collecting dish
76A: communication flow path
76B: cleaning liquid supply port
76C: collecting flow path
76D: cleaning liquid discharge port
78: cleaning liquid spurting port
80: supply flow path
88: collecting hole
112-*i* (i=1 to n): head module
116: frame
118: flexible substrate
122: head module holding member
124: head protecting member
128: nozzle
130: nozzle plate
132: pressure chamber
134: supply port
136: common flow path
138: flow path plate
140: diaphragm
142: individual electrode
144: piezoelectric element
146: common electrode
150: ink chamber unit
160: ink supply port
162: ink collection port
164: supply side pressure sensor
166: collection side pressure sensor
200: ink supply system
202: main tank
204: main tank connecting pipe
206: buffer tank
206A: atmospheric opening hole
208: main pump
212: first supply flow path
214: supply tank
214A: supply ink chamber
214B: supply gas chamber
216: second supply flow path
220: first collecting flow path
222: collecting tank
222A: collecting ink chamber
222B: collecting gas chamber
224: second collecting flow path
228: supply pump
234: collecting pump
238: elastic film
242: atmospheric opening pipe
244: atmospheric opening valve
246: elastic film
250: atmospheric opening pipe
252: atmospheric opening valve
300: wiping unit
300C: wiping unit
300K: wiping unit
300M: wiping unit
300Y: wiping unit
302: main body frame
304C: wiping unit mounting portion
304K: wiping unit mounting portion
304M: wiping unit mounting portion
304Y: wiping unit mounting portion
310: wiping web
312: case
314: feeding shaft
316: rolling shaft
318: pressing roller
320: front guide
322: rear guide
324: grid roller
326: case main body
338: feeding core
342: rolling core
358: rolling shaft gear
360: first front guide
360A: upper edge portion
362: second front guide
362L: flange
362R: flange
364: first rear guide
364A: upper edge portion
366: second rear guide
366L: flange
366R: flange
368A: bracket
368B: bracket
370: lifting and lowering stage
400: movement control unit
402: transporting control unit
406: image recording control unit
408: moisturizing unit control unit
410: cleaning liquid control unit
412: wiping control unit
414: back pressure control unit
500: damage

What is claimed is:

1. A recording head cleaning device comprising:

a cleaning liquid holding unit that has a cleaning liquid holding surface;

a cleaning liquid applying portion that applies a cleaning liquid to the cleaning liquid holding surface;

a cleaning unit that cleans a nozzle surface of a recording head, in which a nozzle jetting an ink is disposed, with the cleaning liquid held by the cleaning liquid holding surface by making the cleaning liquid holding surface and the nozzle surface face each other; and a back pressure control unit that sets a back pressure of the nozzle in a case of cleaning the nozzle surface to −800 pascals to −200 pascals.

2. The recording head cleaning device according to claim 1, wherein the back pressure control unit sets the back pressure of the nozzle in the case of cleaning the nozzle surface to −700 pascals to −300 pascals.

3. The recording head cleaning device according to claim 2, wherein the back pressure control unit sets the back pressure of the nozzle in the case of cleaning the nozzle surface to −600 pascals to −400 pascals.

4. The recording head cleaning device according to claim 1, wherein the cleaning unit relatively moves the recording head in a first direction parallel to the cleaning liquid holding surface in a state where the cleaning liquid holding surface and the nozzle surface face each other.

5. The recording head cleaning device according to claim 4, further comprising:

a wiping portion that wipes the nozzle surface with a wiping member.

6. The recording head cleaning device according to claim 5, wherein the back pressure control unit sets the back pressure of the nozzle in a case of wiping the nozzle surface to −2,100 pascals to −1,900 pascals.

7. The recording head cleaning device according to claim 4, wherein the cleaning liquid holding surface has a rectangular shape of which a length in the first direction is W and a length in a second direction orthogonal to the first direction is Dm, the cleaning unit causes the cleaning liquid holding surface and the nozzle surface of the recording head, of which a length in the second direction is Dh which is smaller than Dm, to face each other at a distance H, and the cleaning liquid applying portion applies a larger amount of the cleaning liquid than W×Dh×H.

8. The recording head cleaning device according to claim 4, wherein in the recording head, a plurality of head modules, in which the nozzles are disposed, are arranged in the first direction.

9. The recording head cleaning device according to claim 1, wherein the cleaning liquid holding unit has a cleaning liquid supply port in the cleaning liquid holding surface, and the cleaning liquid applying portion causes the cleaning liquid to be spurted from the cleaning liquid supply port.

10. The recording head cleaning device according to claim 9, wherein the nozzle surface has a liquid repellent nozzle portion, in which a plurality of the nozzles are disposed, and a non-nozzle portion, which has liquid repellency relatively lower than the nozzle portion, and the cleaning unit causes the cleaning liquid supply port and the non-nozzle portion to face each other.

11. The recording head cleaning device according to claim 1, wherein the cleaning unit causes the cleaning liquid holding surface and the nozzle surface to face each other in a state of being tilted with respect to a horizontal surface.

12. The recording head cleaning device according to claim 1, wherein the nozzle jets an ink containing at least one of a metal pigment or carbon black.

13. A recording device comprising:

the recording head cleaning device according to claim 1;

the recording head;

a movement unit that relatively moves the recording head and a recording medium; and a recording control unit that controls the recording head and the movement unit to record an image on the recording medium.

14. The recording device according to claim 13, wherein the back pressure control unit sets the back pressure of the nozzle in a case of recording the image to −1,100 pascals to −900 pascals.

15. A recording head cleaning method comprising:

a cleaning liquid applying step of applying a cleaning liquid to a cleaning liquid holding surface of a cleaning liquid holding unit having the cleaning liquid holding surface;

a cleaning step of cleaning a nozzle surface of a recording head, in which a nozzle jetting an ink is disposed, with the cleaning liquid held by the cleaning liquid holding surface by making the cleaning liquid holding surface and the nozzle surface face each other; and a back pressure controlling step of setting a back pressure of the nozzle in a case of cleaning the nozzle surface to −800 pascals to −200 pascals.

* * * * *